United States Patent [19]

Rudy

[11] 3,994,692

[45] Nov. 30, 1976

[54] SINTERED CARBONITRIDE TOOL MATERIALS

[76] Inventor: Erwin Rudy, 15750 NW. Oak Hill Drive, Beaverton, Oreg. 97005

[22] Filed: May 29, 1974

[21] Appl. No.: 473,502

[52] U.S. Cl. ..... 29/182.5; 29/182.7; 29/182.8; 75/203; 75/204; 75/205; 75/175.5; 148/126

[51] Int. Cl.[2] ..... B22F 3/00

[58] Field of Search ..... 27/182.7, 182.8, 182.5; 75/203, 204, 205, 175.5; 148/126

[56] References Cited

UNITED STATES PATENTS

| | | | |
|---|---|---|---|
| 3,479,155 | 11/1969 | Rudy | 29/182.1 |
| 3,671,201 | 6/1972 | Bergna | 29/182.5 |
| 3,703,368 | 11/1972 | Rudy | 75/175.3 |
| 3,741,733 | 6/1973 | Kieffer | 75/204 |

FOREIGN PATENTS OR APPLICATIONS 2,219,409 11/1972 Germany

OTHER PUBLICATIONS

Chem. Abs. No. 76:17124k, vol. 76, p. 179, 1972.

*Primary Examiner*—Brooks H. Hunt
*Attorney, Agent, or Firm*—Ronald W. Reagin

[57] ABSTRACT

A composition of material is disclosed which comprises sintered carbonitride-binder metal alloys. The carbonitride has a gross composition falling within the area ABCD of FIG. 1, and within the additional concentration limits also specified in FIG. 1. The binder is selected from metals of the iron group and comprises between 3 and 20 weight percent of the composition.

11 Claims, 14 Drawing Figures

SINTERED CARBONITRIDE TOOL MATERIALS

The present invention relates to improved cemented carbonitride alloys and more particularly to improved carbonitride alloys based on a combination of titanium-rich carbonitride compositions in which the metal component is further alloyed with hafnium and group V and group VI metals, tungsten carbide, and an iron metal binder, preferably cobalt.

Commercial steel cutting carbide grades consist of titanium-tantalum-tungsten carbides cemented with cobalt. The hard phases in a steel roughing grade typically consist of comparable volume percentages of cubic carbide, which cintains practically all of the titanium and tantalum, as well as some tungsten in the form of a solid solution, while the remainder consists of essentially unalloyed tungsten carbide. The titanium carbide provides the necessary cratering resistance, while tantalum carbide improves thermal deformation resistance and also adds to the crater wear properties without detrimentally affecting alloy toughness. The high thermal conductivity, combined with its good binder wetting properties, make tungsten carbide an indispensable ingredient for achieving adequate toughness and thermal shock resistance in these alloys.

Replacement of tantalum carbide by the chemically very similar niobium carbide, or by hafnium carbide, is known to improve wear performance, but has generally been believed to have an adverse effect on toughness. While toughness of such alloys can be improved by increasing the binder content and/or grain size of the hard components, the resulting decrease of the thermal deformation resistance may render the material uncompetitive with existing carbide grades. However, in a study published by R. Kieffer, G. Travesinger and N. Reiter, Planseeberichte fuer Pulvermetallurgie 17, 1969, page 25, strength and toughness properties of commercial carbide grades were said to be improved by partial substitution of tantalum by niobium and/or hafnium. This study presented no data to support that contention.

Attempts to exploit the excellent wear properties of nitrides in composite tools with tungsten and other carbides, such as are reported by O. Meyer and W. Eilender: Archiv F. d. Eisenhuettenwesen 11 (1938), 545, have resulted in materials with poor strength properties and were thus not cmpetitive with the existing cemented carbides.

As is reported by R. Kieffer, P. Ettmayer and M. Freudhofmeier, Metall 25, (1971) p.1335, work on tool materials for high speed finish of steels has resulted in improvements in the strength properties of cemented titanium carbonitrides, while binder wetting of zirconium and hafnium carbonitrides proved inadequate. Competitive carbonitride alloys for high speed finishing of steels and super alloys were only recently achieved through use of a novel decomposition reaction on the Ti—Md(W)—C—N system but, because of their low thermal conductivity, these carbonitrides are not suitable for interrupted cuts and milling operations at heavy feed rates. See my earlier U.S. Pat. No. 370,865 filed: June 18, 1973 and E. Rudy, S. Worcester, and W. Elkington, Proceedings of the 8th Plansee Seminar, Reutte, Tirol, May 1974.

It is accordingly an object of the present invention to provide an improved composition of material based on carbonitride alloys with improved toughness, strength, and wear characteristics when compared with commercial roughing grades for steel.

It is another object of the present invention to provide improved cemented carbonitride alloys for combining the beneficial properties of spinodal carbonitride ingredients with those of tungsten carbide to achieve the toughness, hot strength, and thermal shock properties required for the intended applications.

It is another object of the present invention to provide such carbonitride alloys which are stable under vacuum sintering conditions in the presence of iron group metal binder alloys.

It is a further object of the present invention to provide such alloys, in which the spinodal alloy interacts with the binder, and with other addition carbides, in a manner which ensures good binder wetting and therefore good strength properties, and which also prevents embrittlement of the composites through accumulation of undesirable elements, such as hafnium and niobium, in the binder.

Briefly stated, and in accordance with the present invention, a cemented carbonitride alloy is provided in which the carbonitride component has a gross composition expressed by the equation $(M'_xM_y)\ (C_uN_v)_z$, wherein M' represents selected combinations of the elements titanium, hafnium, niobium and tantalum, $(Ti_A{}^{\circ}(Hf_rNb_sTa_t)_b$ , and M reprsents selected combinations of the elements molybdenum and tungsten $(WaMo_b)$. Of course the mole fractions $x + y = 1$ and the mole fractions $u + v = 1$. The values $u$, $v$, $x$, $y$ are defined by the area ABCD of the attached FIG. 1, and the value of $z$, the stoichiometry parameter, is between 0.90 and 1. The elements hafnium, niobium, and tantalum are completely interchangeable and their relative concentrations are given by the parameter $r$, $s$ and $t$, where $r + s + t = 1$, but the combined mole fractions of these elements, $b'$ $(a' + b' = 1)$, are not to exceed the mole fraction of titanium, i.e., $b' \leq a'$. The mole fraction of molybdenum in M, $b$ $(a + b = 1)$, is not to exceed that of tungsten, i.e., $b \leq a$. The binder phase is selected from the iron group metals and comprises between 3 and 20 percent by weight of the composition.

In the preferred range of the present invention, the carbonitride component has a gross composition in which the values of $u$, $v$, $x$ and $y$ are defined by the area A'B'C'D' of FIG. 1 while the values of the other concentration parameters have the same limits as above. The binder phase is selected from the group consisting of cobalt and nickel and comprises between 4 and 12 percent by weight of the composition.

For a complete understanding of the present invention, together with an appreciation of its other objects and advantages, please see the following detailed description of the attached drawings, in which.

Although the cemented carbonitride alloys can comprises smaller quantities of a large number of different alloying elements, the preferred embodiments of the cemented carbonitrides of this invention are based on the system Ti—X—W—C—N, whereby X stands for the elements hafnium, niobium and tantalum.

The gross composition of the hard component in the cemented alloys of the invention are conveniently expressed as relative mole fractions of metal and interstitial elements in the form $(M'_xM_y)(C_uN_v)_z$, $(x+y=1;$ $u+v=1)$, whereby $x$ and $y$ are, respectively, the mole fractions, (metal exchange) of the metal components M' and M; M' represents the metal component $Ti_a$ $(HF_rNb_sTa_t)_b$ $(a'+b'=1)$; $(r+s+t=1)$ in the carbonitride in which $a'$ is the relative mole fraction of titanium, and $b'$ the combined relative mole fractions $(r, s, t)$, of the principal alloying addition elements hafnium $(r)$, niobium $(s)$, and tantalum $(t)$; M represents the group VI metal component $W_aMo_b$ $(a+b=1)$ of the carbonitride, in which $a$ and $b$ are, respectively, the relative mole fractions of tungsten and molybdenum; $u$ and $v$ are, repsectively, the mole fractions of carbon and nitrogen of the interstitial element component; and the stoichiometry parameter $z$ is the ratio of the combined number of gram atoms of carbon and nitrogen per gram atom metal (M' + M).

Note that the terms $a'\cdot x$, $r\cdot b'\cdot x$, $s\cdot b'\cdot x$, $t\cdot b'\cdot x$, $a\cdot Y$ and $b\cdot Y$ denote the gross mole fractions of, respectively, titanium, hafnium, niobium, tantalum, tungsten and molybdenum in the metal component of the carbonitride. Gross tool alloy compositions in the tables are given in the latter notation; if desired, the individual parameters $a'$, $b'$, $r$, $s$, $t$, $a$ and $b$ can be readily determined from the given gross mole fractions with the aid of the above relations.

Figure 1:
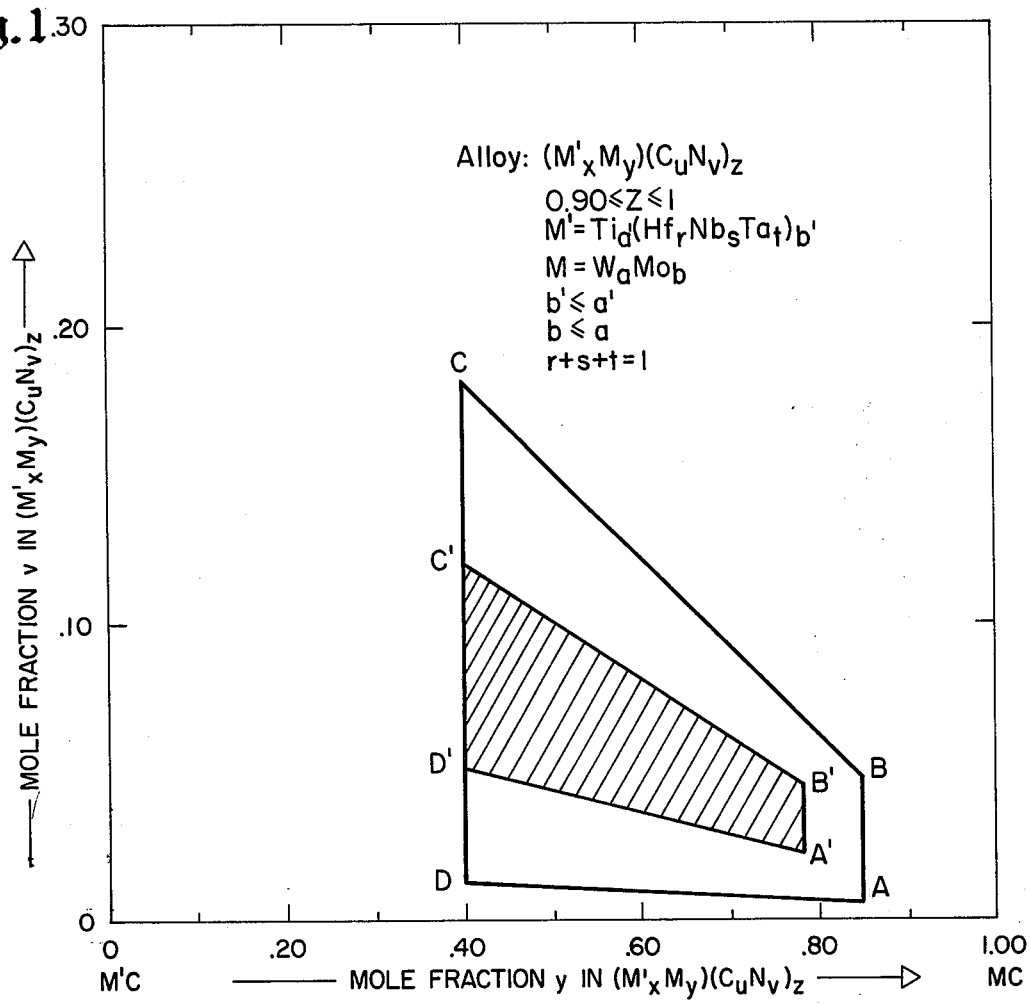
FIG. 1 is a graphical presentation with supplementary specifications of the gross compositions of the carbonitride alloys of the present invention.

FIG. 1 is a graphical presentation of the gross composition of the hard phase (carbonitride) component used as input material in the fabrication of the alloy compositions of the present invention. In the chosen notation, the ordinate in FIG. 1 is the mole fraction $v$, (nitrogen exchange in the alloy), while the abscissa corresponds to the mole fractions $y$ (M-exchange in the alloy). Both composition axes are also defined $u$ and $x$, since $x+Y=1$ and $u+v=1$. The gross carbonitride compositions of the tool alloys in accordance with the present invention generally fall within the composition area bounded by ABCD, but preferably within the more confined area A'B'C'D' in FIG. 1, with the following additional constraints also noted in FIG. 1, namely, that $z$ shall be variable between the limits 0.90 and 1, i.e., $0.90 \leq z \leq 1$; that the relative mole fraction of molybdenum is not to exceed that of tungsten, i.e., $b \leq a$; that the addition metals hafnium niobium, and tantalum are completely interchangeable, with their relative concentrations being given by the parameters $r$, $s$ and $t$, where $r+s+t=1$; and that the combined relative mole fractions of hafnium, niobium and tantalum shall not exceed the mole fraction of titanium, i.e., $b' \leq a'$. In the chosen notation, and observing the constraints regarding the composition limits for the metal components defined above, :composition A corresponds to $(M'_{.15}M_{.85})(C_{.995}N_{.005})_z$, composition B to $(M'_{.15}M_{.85})(C_{.995}N_{.045})_z$, composition C to $(M'_{.60}M_{.40})(C_{.82}N_{.18})_z$, composition D to $(M'_{.60}M_{.40})(C_{.985}N_{.015})_z$; composition A' to $(M'_{.22}M_{.78})(C_{.98}W_{.02})$ z, composition B' to $(M'_{.22}M_{.78})(C_{.95}N_{.05})_z$, composition C' to $(M'_{.60}M_{.40})(C_{.88}N_{.12})_z$, and composition D' to $(M'_{.60}M_{.40})(C_{.95}N_{.05})_z$.

Figure 2:
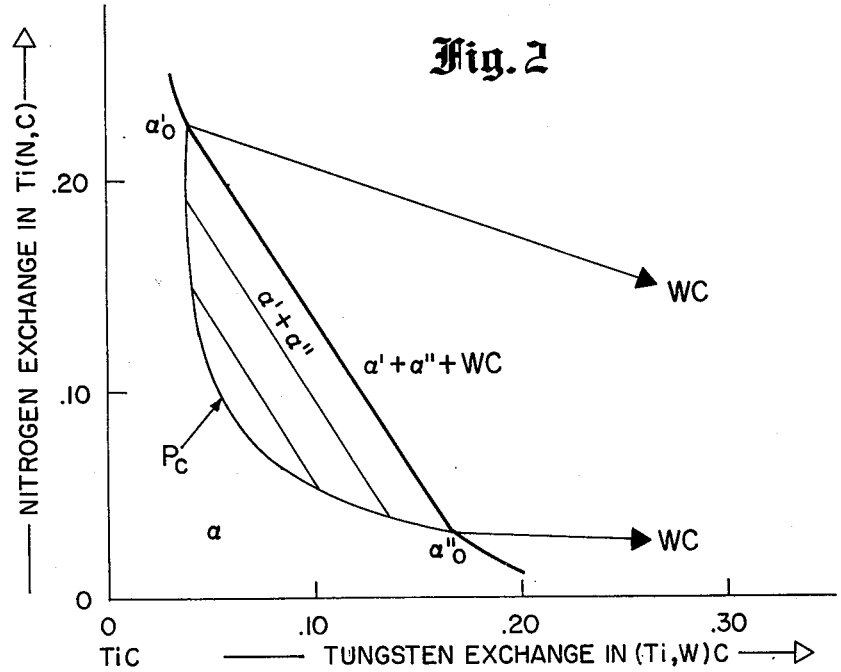
FIG. 2 is a diagrammatic presentation of the relevant phase equilibria as they exist in the (Ti, W) (C, N) system at temperatures in the vicinity of 1400° C.

Some of the alloying principals underlying the materials of the invention are demonstrated by FIG. 2, which shows the partial phase diagram for the Ti—W—C—N system at temperatures of approximately 1400° C and for $z$-values close to one. The ordinate and abscissa of FIG. 2 are, respectively, the mole fraction $v$ (nitrogen exchange) in the pseudobinary solid solution $Ti(N, C)_z$ and the mole fraction $y$ (tungsten exchange) in the pseudobinary solid solution $(Ti, W)C_z$. The range denoted $\alpha$ designates the homogeneous field of the solid solution $(Ti, W)(C, N)_z$, the range denoted $\alpha'+\alpha''$ encompasses the extent of the miscibility gap, and the point $P_c$ is the critical point of the system at the given temperature. Adjoining the miscibility gap towards the tungsten side is a three-phase equilibrium, in which the terminal members $\alpha'_o$ and $\alpha''_o$ of the carbonitride solid solution are in equilibrium with practically unalloyed tungsten monocarbide. Towards higher temperatures the size of the miscibility gap becomes smaller and the critical point $P_c$ shifts more towards the center of the composition quadrangle; the tie line connecting the terminal compositions $\alpha_o'$ and $\alpha_0''$ shrinks with increasing temperature and ultimately degenerates into a point coinciding with the critical point $P_c$; above the temperature of this degeneracy, indicated to be in the vicinity of 1600° to 1650° C, the three-phase equilibrium $\alpha'+\alpha''+WC$ no longer exists and its place is taken by a two-phase equilibrium in which tungsten carbide, WC, is in equilibrium with a wide range of carbonitride solid solutions $Ti, W)(C, N)_z$. The extent of the miscibility gap and the location of the vertices (end points) of the three-phase equilibrium $\alpha'+\alpha''+$ WC are dependent dependent on the degree of interstitial element deficiency, i.e., the value of the stoichiometry parameter $z$; the miscibility gap becomes smaller with increasing interstitial element deficiency, so that degeneration of the three-phase equilibrium $\alpha'+\alpha''$ 30 WC occurs at a lower temperature at substoichiometric $(z \leq 1)$ compositions; the apparent tungsten carbide solubility in the carbonitride is therefore higher at substoichiometric compositions.

In conjunction with the description of the alloys of the invention, consideration of several properties of the coexisting phases and the disposition of the phase equilibria, as well as the reactions occurring with separate alloying addition phases, is important.

First, substitution of nitrogen for carbon reduces the solubility of tungsten carbide in the cubic $\alpha$ phase, and thus, for a fixed metal exchange, increases the amount of free tungsten carbide and as a consequence, toughness and thermal conductivity of the alloys. Secondly, the lattice parameters of the $\alpha'$ and $\alpha''$ phases are nearly exactly identical to the range of compositions of interest here. Owing to the better wetting characteristics and the higher solubility of the $\alpha''$ phase in the iron metal binder, the $\alpha''$ phase is transported preferentially during sintering and tends to grow epitaxially around the $\alpha'$-grains. In this way, the $\alpha''$ -phase protects the nitrogen-rich $\alpha'$ phase from decomposition during vacuum sintering, while simultaneously providing good bonding between the cubic $\alpha$ phase and the binder. Thirdly, the existence of the miscibility gaps permits the introduction of phases desirable to add wear resistance to the alloy, such as hafnium carbonitride, without detrimentally impairing fabricability and strength properties of the alloys; the hafnium, as well as oxygen impurities, preferentially accumulate in the $\alpha'$-phase during the initial stages of sintering, so that sintering behavior and bonding characteristics are primarily determined by the better wetting, low-nitrogen, $\alpha''$ phase. The higher affinity of hafnium to nitrogen also causes a lower residual hafnium content in the binder phase and thus diminishes the possibility for binder embrittlement.

The phase equilibria as shown in FIG. 2 are modified only in degree, not in principal, by alloying additions at concentration levels within the limits set in this specification; for a given temperature, hafnium additions cause a shift of the critical point $P_c$ in the direction of the TiC-corner and a stronger inclination of the line sts $\alpha'\alpha''$ towards the Ti(C, N)-rich quasibinary edge system. Hafnium concentrations higher than that of titanium can result in the formation of two separate $\alpha'$ (group IV metal-and nitrogen-rich phases), besides $\alpha''$ and tungsten carbide; the considerable lattice mismatch between the hafnium-rich $\alpha''$-phase and the tungsten-rich $\alpha''$-phase destroys lattice coherency and, in conjunction with the high nitrogen content of the $\alpha''$-phase, causes considerable difficulties in obtaining dense parts at acceptable sintering temperatures. Niobium substitutions for titanium cause a decrease in the size of the miscibility gap and the temperature of the $\alpha' + \alpha'' + WC$ degeneracy. Tantalum has a similar effect as niobium, but additionally causes a rise of the nitrogen decomposition pressure; alloys with more than 40 mole percent nitrogen in the $\alpha'$ phase which contains tantalum as sole alloying addition to (Ti, W) (C, N), cannot be sintered in vacuum without incurring partial nitrogen depletion. Molybdenum in replacement for tungsten causes a slight shift of critical $P_c$ and boundary tie line $\alpha'_o\alpha''_o$ away from the TiC corner, thus in effect increasing the group VI metal solubility in the carbonitride and decreasing the amount of free tungsten carbide at a given group VI metal exchange.

It is thus possible, while preserving the beneficial phase equilibrium characteristics displayed in the (Ti, W) (C, N) system to considerably vary composition, and thus the properties of the composites. The effect of the above-described alloying additions, as well as others, on fabricability, properties and performance of the alloys of the invention will be discussed in more detail below.

One additional point worth of discussion concerns the buffering action of the nitrogen in the alloys of the invention with respect to free carbon and the formation of wear resistant, adherent surface layers by nitrogen depletion of the sample surface during sintering.

In hyperstoichiometric alloys ($z>1$), the excess interstitial element content is present as free carbon. The exchange reaction $$\langle N\rangle_{carbonitride,\ z\approx 1} + C_{graphite} \rightarrow \tfrac{1}{2}\,(N_2)_{gas} + \langle C\rangle_{carbonitride}$$

is favored by the presence of free carbon, i.e., the nitrogen decomposition pressure is highest when free carbon is present; during the presintering and early sintering stage, excess carbon present due to misadjustment of the composition of the master carbonitride, will be consumed through loss of an equivalent amount of nitrogen from the carbonitride according to the above reaction scheme. Once all excess carbon is consumed the decomposition pressure of the carbonitride in the reaction $$\langle N\rangle_{carbonitride,\ z<1} \rightarrow \tfrac{1}{2}\,(N_z)_{gas}$$

decreases rapidly once the stoichiometry parameter drops to values less than one, and further decomposition of the bulk alloy becomes increasinging difficult. Near the surface, however, gradual low level nitrogen depletion during sintering causes extensive binder alloying and formation of a binder-depleted, hard surface zone. This surface layer which, depending on the composition of master carbonitride and the sintering conditions, varies in thickness between about 3 to 15 micrometers, adheres well to the substrate and has considerable better cratering resistance than the bulk alloy. Absence of free carbon in the alloy is also of particular importance when the tools are to be coated, since it is well-documented that chemically deposited layers of carbides and nitrides do not adhere if the tools contain excess carbon.

The carbonitride alloys of the invention may be fabricated by several different powder metallurgical techniques. A typical fabrication procedure is as follows: carbonitride master alloys, eventual alloying additions, tungsten carbide and binder alloy powders are mixed in the desired proportions and ball-milled in carbide-lined or plan steel jars for 2 to 4 days, using tungsten carbide-cobalt alloy balls and inert milling fluids, such as naphta and benzene. Depending on the powder density, 1 to 4 weight percent pressing lubricant, usually paraffine, is added in a suitable solvent such as naphta. The milling fluid and paraffine solvents are evaporated and the dry powder mixture compacted into the desired shapes at pressures varying between 10 and 20 tons per square inch. The pressing lubricant is removed by gradual heating to temperatures up to 400° C under vacuum. The compacts, which are stacked on suitable supports such as graphite, are first degassed and presintered during a ½ to 1 hour period at temperatures between 1150° and 1230° C, and then sintered for 1 to 1½ hours at 1430° to 1480° C under vacuum. Unless the parts have been pressed to final shape and are intended to be used in the as-sintered state, the parts are ground on diamond wheels to the desired tool geometry.

The carbonitride alloys used in the preparation of the composites of the invention can be prepared in different ways. The preferred method, hereafter called Method 1, consists of in situ nitriding of suitable mixtures of carbides and refractory metal at temperatures varying between 1400° and 1800° C under nitrogen, or a nitrogen-bearing atmosphere, such as ammonia. In a second method of preparation, hereafter called Method 2, separately prepared master alloys of nitrides and carbides are mixed in the desired proportions and homogenized by exposure to high temperatures (1700° to 2100° C) under a nitrogen atmosphere. The homogenized mixtures are then crushed and comminuted to the desired grain size for use in the tool alloy batching.

Method 1 is generally preferably, because the chance of oxygen contamination is less and homogenization of the alloys is also easier to achieve. The carbonitride master alloys for all tool compositions described in this specification of the alloys of the invention were therefore prepared according to Method 1.

A laboratory fabrication procedure for a carbonitride master alloy typically used in the fabrication of C-5 type cutting tool alloys in accordance with the present invention, is as follows:

Graphite trays, packed with an intimately blended mixture consisting of 53.2 weight percent TiC, 11.2 weight percent WC, and 35.60 weight percent tungsten, are stacked into the heating zone of a graphite element high temperature furnace and the load heated under vacuum to about 1300° C until all degassing has subsided. Nitrogen gas is then admitted to the furnace chamber and the temperature gradually raised to about 1500° C, while replenishing from time to time the nitrogen consumed in the nitriding reaction. After about 4 hours at temperature, nitrogen consumption gradually diminishes and the temperature is then further raised to 1650° C to 1680° C, and the mixture held for approximately 2 hours at this temperature, to complete the reaction and to homogenize the alloy. After shutting off the power to the furnace, the nitrided product is allowed to cool under nitrogen, the reacted lumps are crushed and further comminuted to a grain size less than 75 micrometers.

The nitrided product typically has a nitrogen content of 2.75 to 2.80 weight percent, correspondingly to a gross composition of the carbonitride master alloy $(Ti_{.78}W_{.22})(C_{.83}N_{.17})_{\sim 1}$ in the chosen notation. X-ray diffraction and metallographic examination of the nitrided product show two face-centered cubic phases with practically identical lattice parameters, accompanied by quantities of tungsten carbide.

The preparation of other master carbonitrides is generally similar, except for higher nitriding temperature and longer reaction times for compositions containing substantial concentrations of hafnium, while lower nitriding temperatures are permissible for molybdenum-rich comparison. The master carbonitride compositions, including eventual addition carbides, such as HfC, TaC, NbC, and solid solutions of these carbides, are premilled for approximately 40 hours under an inert milling fluid (naphta, benzene) and used as 2 to 4 micron powder in the batching of the tool alloys.

Those skilled in the art can devise other methods, or variations of the in situ nitriding method, to achieve a particular composition; but in whatever manner these alloys are fabricated, it is important that the alloys contain sufficient nitrogen to prevent the formation of $\eta$-carbide in the tool alloy, and that the nitrided alloy is sufficiently homogeneous to minimize undesirable diffusion reactions during sintering which can impair fabricability and properties to the finished alloy.

Aside from the routine fabrication variables, choice of the carbonitride ingredient, addition carbides, grain size distribution of the tungsten carbide used in the tool batching, as well as milling and sintering conditions, strongly influence microstructure and phase constituents and, as a result, the properties of the sintered compacts. Although no generally valid guidelines can be given because each individual application has its own special requirements, cutting tests have shown that the best overall performance is obtained with tools prepared from alloys in which the stoichiometry parameter z does not differ substantially from 1, the tungsten carbide has a dual grain structure consisting of larger grains of 6 to 12 micron size and smaller grains averaging about 2 microns, and the grains of the cubic phase are small and are separated from each other by a more or less continuous skeleton of tungsten carbide. In contrast to carbide alloys, grain growth of the carbonitride-tungsten carbide-binder mixture during sintering was not found to pose any problem and grain size distribution in the sintered alloys is predictable from the distribution in the as-milled batch.

The following tables and graphs show the performance of a large number of tools having different compositions within the range of the invention and also give comparison data for prior art tools designed for similar applications.

Five different test conditions, four on 4340 steel, and one on the commercially superalloy INCONEl 625, were used. These are designated as Test Condition A, Test Condition B, Test Condition C, Test Condition D, and Test Condition E. The test tool and commercial comparison tool were run in alternate passes in order to eliminate effects from variations in the properties in the test alloy bars. Unless otherwise noted, the test conditions referred to in the tables are as follows:

TEST CONDITION A (Wear Test)

4340 steel, $R_c$ 20 to 28; cutting speed 500 surface feet per minute; feed rate, 0.0152 inch per revolution; depth of cut, 0.050 inch, no coolant. SNG 433 or 423 inserts.

TEST CONDITION B (Thermal Deformation Test)

4340 steel, $R_c$ 20 to 28; cutting speed, 500 surface feet per minute; feed rate, 0.040 inch per revolution; depth of cut, 0.060 inch, no coolant; 1 minute cutting time. SNG 433 or 423 inserts.

TEST CONDITION C (Milling Test, Single Tooth Cutter)

4340 steel, $R_c$ 18 to 23; cutting speed, 600 surface feet per minute; feed rate, 0.0125 inch per revolution; depth of cut, 0.100 inch; tool engagement in cycle, 12.5%; total number of interruptions, 4000; no coolant. SNG 433 or 423 inserts, edges not honed.

TEST CONDITION D (Routh Milling, Single Tooth Cutter)

4340 steel, $R_c$ 18 to 23; cutting speed, 480 surface feet per minute; feed rate, 0.033 inch per revolution; depth of cut, 0.100 inch; tool engagement in cycle, 12.5% total number of interruptions, 500; no coolant. SNG 433 inserts, dges 0.002 inch hone.

TEST CONDITION E (Superalloy Test)

INCONEL 625, partially aged; cutting speed 250 surface feet per minute; feed rate, 0.0101 inch per revolution; depth of cut, 0.100 inch, coolant. SNG 433 or 423 inserts.

To obtain a comparative performance evaluation of the composites of the invention, a cross section of representative tools from different manufacturers was also tested under identical conditions and the best performing tools selected as comparison standards. The compositions of the commercial tools from the three different application categories also envisioned for the alloys of the invention are as follows:

| | Gross Composition |
|---|---|
| C-2 Grade | WC + 6 wt. % Co |
| C-5 Grade | $(Ti_{.24}Ta_{.10}W_{.66})C$ + 8.5 wt % Co |
| C-7 Grade | $(Ti_{.33}Ta_{.10}W_{.57})C$ + 4.5 wt % Co |

The following seven examples, which are representative of some of the compositions of the present invention, describe in detail six specific compositions and the manner in which they are fabricated. In all of these examples, the value of the parameter $z$ varied from 0.94 to approximately 1.0. Variations of $z$ in this range had no significant effect on wear.

EXAMPLE 1 — (C-5 grade)

Gross Composition: $(Ti_{.24}{}^{Hf}{}_{.05}{}^{Nb}{}_{.05}{}^{W}{}_{.66})$ $(C_{.94}{}^{N}{}_{.06})$ + 13 Vol% Co A mixture consisting of 25.80 weight percent of a premilled master alloy blend [master alloy blend: 67 weight percent $(Ti_{.75}{}^{W}{}_{.25})$ $(C_{.81}{}^{N}{}_{.19})$ and 33 weight percent $(Hg_{.5}{}^{Nb}{}_{.5})C$], 65.70 weight percent tungsten-carbide powder, and 8.50 weight percent cobalt is milled for 70 hours in a stainless steel jar using ¼ inch diameter tungsten carbide balls and benzene as milling fluid. The milling powder slurry is dried, 1.75 weight percent paraffine added as pressing aid, the mixture homogenized in a blender and isotatically pressed at 6000 psi, and the compacts granulated. The granulated material (150 to 600 microns) is pressed at 15 tons per square inch into parts and dewaxed in a 3 hour cycle at 350° C under vacuum. The dewaxed compacts are presintered for approximately 1 hour at 1200° C under vacuum and sintered for 1 hour and 20 minutes at 1455° C. Dependent upon the chosen grain size, hardness of the sintered alloy can vary between Rockwell A ($R_A$) 91.0 and 92.3, the bending strength between 300 and 260 ksi (ksi = thousand pounds per square inch), and the magnetic coercive force between Hc 140 and 165.

EXAMPLE 2 — (C-5 grade)

Gross Composition $(Ti_{.24}Hf_{.05}NB_{.05}W_{.66})$ $(C_{.89}N_{.11})$ + 13 vol%Co A mixture of 25.15 weight percent of a premilled carbonitride master alloy $(Ti_{.59}Hf_{.12}Nb_{.12}W_{.17})$ $(C_{.71}N_{.29})_{.96}$, 66.35 weight percent tungsten carbide, and 8.50 weight percent cobalt is ball milled and processed in the same manner as described under xample 1 and sintered for 1 hour and 30 minutes at 1470° C. Dependent upon grain size, the hardness of the sintered alloy can vary between $R_A$ 91.2 and 92.1, the bending strength between 210 and 250 ksi, and the coercive force between $H_c$ 145 to 170.

EXAMPLE 3 — (Low-alloy C-7 grade)

Gross Composition: $(Ti^{.25}Hf_{.05}Ta_{.05}W_{.65})$ $(C_{.95}N_{.05})$ + 7.2 vol% Co A mixture consisting of 27.20 weight percent of a premilled master alloy blend [master alloy blend: 58.60 weight percent $(Ti_{.8}W_{.2})$ $(C_{.83}N_{.17})\sim_1$ and 41.40 weight percent $(Hf_{.5}Ta_{.5})C$], 67.80 weight percent tungsten carbide, and 5 weight percent cobalt is milled for 60 hours under benzene, processed analogously as described under Example 1, and sintered for 1 hour and 25 minutes at 1475° C. The sintered alloy having the desirable grain size distribution typically has a Rockwell hardness of $R_A$ 92.2, a bending strength of 240 ksi, and a coercive force of Hc = 195.

EXAMPLE 4 — (C-7 grade)

Gross Composition: $(Ti_{.33}Hf_{.05}Nb_{.05}W_{.57})$ $(C_{.91}N_{.09})$ + 7 vol% Co A mixture consisting of 36.30 weight percent of a premilled master alloy blend [master alloy blend: 73.60 weight percent $(Ti_{.75}W_{.25})$ $(C_{.80}N_{.20})\sim_{0.96}$ and 26.40 weight percent $(Hf_{.5}Nb_{.5})C$], 58.50 weight percent tungsten carbide, and 5.20 weight percent cobalt is milled for 55 minutes under benzene and further processed as described under Example 1. The parts were sintered for 1 hour and 30 minutes at 1480° C under vacuum. The alloy typically has a Rockwell hardness of $R_A$ = 92.6, a bending strength of 215 ksi, and a coercive force of $H_c$ = 188.

EXAMPLE 5 — (Low-alloy C-5 grade)

Gross Composition: $(Ti_{.15}Hf_{.05}Nb_{.05}W_{.75})$ $(C_{.96}N_{.04})$ + 13 vol% Co A mixture consisting of 18.05 weight percent of premilled master alloy blend [master alloy blend: 58.85 weight percent $(Ti_{.75}W_{.25})$ $(C_{.75}N_{.25})\sim_{.98}$ and 44.15 weight percent $(Hf_{.5}Nb_{.5})C$], 73.95 weight percent tungsten carbide, and 8 weight percent cobalt is milled for 70 hours and processed as described under Example 1. The parts are sintered for 1 hour and 15 minutes at 1445° C under vacuum. The sintered alloy typically has a Rockwell hardness of $R_A$ = 91.2, a transverse rupture strength of 290 ksi, and a coercive force of $H_c$ = 160.

EXAMPLE 6 — (TiN-coated C-5 grade)

Ground and surface-cleaned samples of the tool alloy described in Example 5 were coated with 21 microns of TiN in a 2 hour chemical vapor deposition cycle at 1080° C, using a gas mixture of $TiCl_4$, nitrogen and hydrogen. In the coating process, the average transverse rupture strength of the alloy dropped from 290 ksi in the uncoated state, to about 275 ksi after application of the coating.

EXAMPLE 7 — (C-6/C-7 grade)

Gross Composition: $(Ti_{.46}Hf_{.0575}Nb_{.0575}W_{.425})$ $(C_{.88}N_{.12})$ + 13 vol% Ni A mixture consisting of 47.40 weight percent of a premilled master alloy blend [master alloy blend: 7460 weight percent $(Ti_{.80}W_{.20})$ $(C_{.81}N_{.20})\sim_1$ and 25.40 weight percent $(Hf_{.5}Nb_{.5})C$], 43.10 weight percent tungsten carbide, and 9.50 weight percent nickel is milled for 65 hours under benzene, 2.50 weight percent paraffine based on the dry weight of the powder added as pressing aid, and further processed as described under Example 1. The compacts were sintered for 1 hour and 20 minutes at 1465° C. The tool alloy had a Rockwell A hardness of 90.8 and a transverse rupture strength of 215 ksi.

Test results and performance data of alloy compositions described in these examples, of other tools in accordance with the invention, and selected prior art tools, when all subjected to the test conditions described above, are given in the following Tables 1 through 5, and FIGS. 3, 4, 5, 6 and 7. Additional data concerning the cratering rate of the alloys of the invention as a function of the concentrations of the different alloying ingredients are shown in FIGS. 10, 11, 12, 13 and 14.

TABLE 1

Wear Pattern of the Tools Described in Examples 1 through 7 in Comparison to Commercial Sintered Carbides. Test Condition A. Hardness of 4340 steel $R_c$ 21.5 to 24

| Tool | Total Cutting Time, Min. | Notch Due to Crater Breakout | Corner Wear | Flank Wear | Scale Line | Crater Depth | Edge Deform | Remarks |
|---|---|---|---|---|---|---|---|---|
| Example 1 | 8.33 | — | .005" | .006"– | .010" | .0029" | .0007" | light heat at end |
| Example 2 | 8.72 | — | .005" | .007" | .010" | .0037" | .0010" | light heat at end |
| Example 3 | 8.20 | — | .003" | .004– | .006" | .0027" | <.0004 | — |
| Example 4 | 15.10 | — | .004" | .004" | .007" | .0031" | <.0006" | — |
| Example 5 | 8.30 | — | .007" | .008"+ | .013" | .0056" | .0013" | — |
| Example 7 | 16.00 | — | .004"+ | .006" | .013" | .0007" | <.0003" | light heat at end |
| C-5 Carbide | 8.22 | — | .008" | .009"+ | .017" | .0070" | .0024" | shriveled chips at end |
| C-7 Carbide | 8.20 | — | .004"– | .005" | .010" | .0029" | <.0005" | — |

TABLE 2

Wear Pattern of the Tools Described in Examples 1 through 7 in Comparison to Commercial Sintered Carbides. Test Condition B. Hardness 4340 steel: $R_c$ 20 to 28

| Tool | Notch Due to Crater Breakout | Corner Wear | Flank Wear | Scale Line | Crater Depth | Edge Deform. | Remarks |
|---|---|---|---|---|---|---|---|
| Example 1 | — | .006" | .005" | <.002" | .003" | .0022" | — |
| Example 2 | — | .009" | .007" | <.002" | .0043" | .0032" | — |
| Example 3 | — | .004" | .004" | <.002" | .0023" | .0010" | — |
| Example 4 | — | .003"– | .003"– | .001" | .0020" | .0010" | — |
| Example 5 | — | .013" | .008" | .002" | .007" | .008" | heavy corner deform. |
| Example 7 | — | .008" | .007" | .005" | .0026" | .0026" | — |
| C-5 Carbide | .014" | .022" | .014" | <.002" | .0069" | .0081" | heavy corner deform. |
| C-7 Carbide | — | .004" | .003" | — | .0027" | .0012" | — |

TABLE 3

Wear Pattern of Coated C-5 Grade Inserts in Comparison to a Coated Commercial C-5 Grade Carbide. Test Condition A. Hardness of 4340 Steel $R_c$ 23 to 25.

| Tool | Coating | Total Cutting Time, Min. | Corner Wear | Flank Wear | Scale Line | Crater Depth | Remarks |
|---|---|---|---|---|---|---|---|
| Example 1 | 5.4μ TiN | 4.50 | .004" | .005" | — | <.0002" | — |
| | | 16.10 | .012" | .010" | — | .0013" | coating worn through in crater area |
| Example 1 | 10.2μ TiN | 17.35 | .007" | .009" | — | .0003" | coating partially worn off at cutting flank |
| | | 26.70 | .010" | .014" | — | .0013" | breakthrough of coating in crater area |
| Example 5 | 11.5μ TiN | 10.29 | .006" | .009" | — | <.0003" | |
| | | 36.25 | .008" | .010" | .011" | .0005" | coating on cutting flank intact |
| Example 5 | 20μ TiN | 17.0 | .007"+ | .009" | — | .0003" | — |
| | | 61.8 | .011" | .014" | .016" | .0012" | coating locally worn through in crater area |
| Example 5 | 9.8μ TiN | 10.49 | .009" | .010" | — | .0003" | |
| | | 21.25 | .011" | .012" | .014" | .0012" | coating worn through in crater area |
| Example 1 | 8μ TiN | 17.42 | .012" | .014" | .017" | .0022" | coating worn off at cutting flank and locally worn through in crater area |
| Commercial C-5 | 11μ TiN | 16.31 | .008" | .009" | — | .0004" | coating spalled off cutting flank |
| | | 25.36 | .0011" | .012"+ | .014" | .0013" | coating locally worn through in crater area |

TABLE 4.

Milling Tests on Tools Described in Examples 1 through 7 and other Test Tools in Comparison to Commercial Sintered Carbides. Test Condition C. Hardness of 4340 Steel: $R_c$ 18 to 23

| Tool | Flank Wear | Crater Depth | Thermal Cracks | Remarks |
|---|---|---|---|---|
| Example 1 | .004"+ | .001" | 2 | |
| Example 3 | .004"– | .0007" | 1 | |
| Example 5 | .005" | .00012" | 1 | |
| Example 7 | .040"local | <.0006" | 5 | Chip near scale line |
| Tool H | .003"– | .009" | 1 | — |
| Tool I | .005"– | .0016" | 3 | .001" deformation at tip |
| Tool J | .004" | .0012" | 1 | — |
| Tool K | .004" | .0009" | 2 | — |
| Tool L | .004" | .0009" | 2 | — |
| Commercial C-5 | .004"+ | .0012" | 2 | — |
| Commercial C-7 | .030"local | .001" | 4 | Chip at flank |

Tool H: $(Ti_{.25}Hf_{.025}Nb_{.025}W_{.70})(C_{.95}N_{.05})$ + 7.4 vol% Co
Tool I: $(Ti_{.15}Hf_{.025}Nb_{.025}W_{.80})(C_{.96}N_{.04})$ + 14.5 vol% Co
Tool J: $(Ti_{.15}Hf_{.025}Nb_{.025}W_{.80})(C_{.96}N_{.04})$ + 10 vol% Co
Tool K: $(Ti_{.28}Hf_{.05}Ta_{.05}W_{.62})(C_{.94}N_{.06})$ + 9.5 vol% Co
Tool L: $(Ti_{.24}Hf_{.05}Nb_{.05}Mo_{.05}W_{.61})(C_{.93}N_{.07})$ + 14 vol% binder (85 wt% Ni, 15wt% Mo)

TABLE 5

Rough Milling Tests on Tools Described in Examples 1 through 7 and other Test Samples in Comparison to Commercial Sintered Carbides. Test Condition D. Hardness of 4340 Steel: $R_c$ 18 to 23

| Tool | Flank Wear | Thermal Cracks | Edge Deform. | Remarks |
|---|---|---|---|---|
| Example 1 | .003" | 1 | <.0003" | |
| Example 3 | .002" | 1 | <.0003" | Small chip near scale line. |
| Example 4 | — | — | — | Edge broke off at .34 minutes. |
| Example 7 | — | — | — | Edge broke off at .02 minutes. |
| Tool M | .002" | none | <.0003" | — |
| Tool N | .003" | none | .0003" | — |
| Tool O | .002" | 1 | <.0003" | — |
| Tool P | .003" | 1 | <.0003" | — |
| Tool Q | .002" | none | <.0003" | — |
| Tool R | .002" | 2 | <.0003" | Small chip at corner. |
| Commercial C-5 | .002" | 1½ | .0004" | — |
| Commercial C-7 | — | — | — | Entire edge broke off at .03 minutes. |

Figure 3:
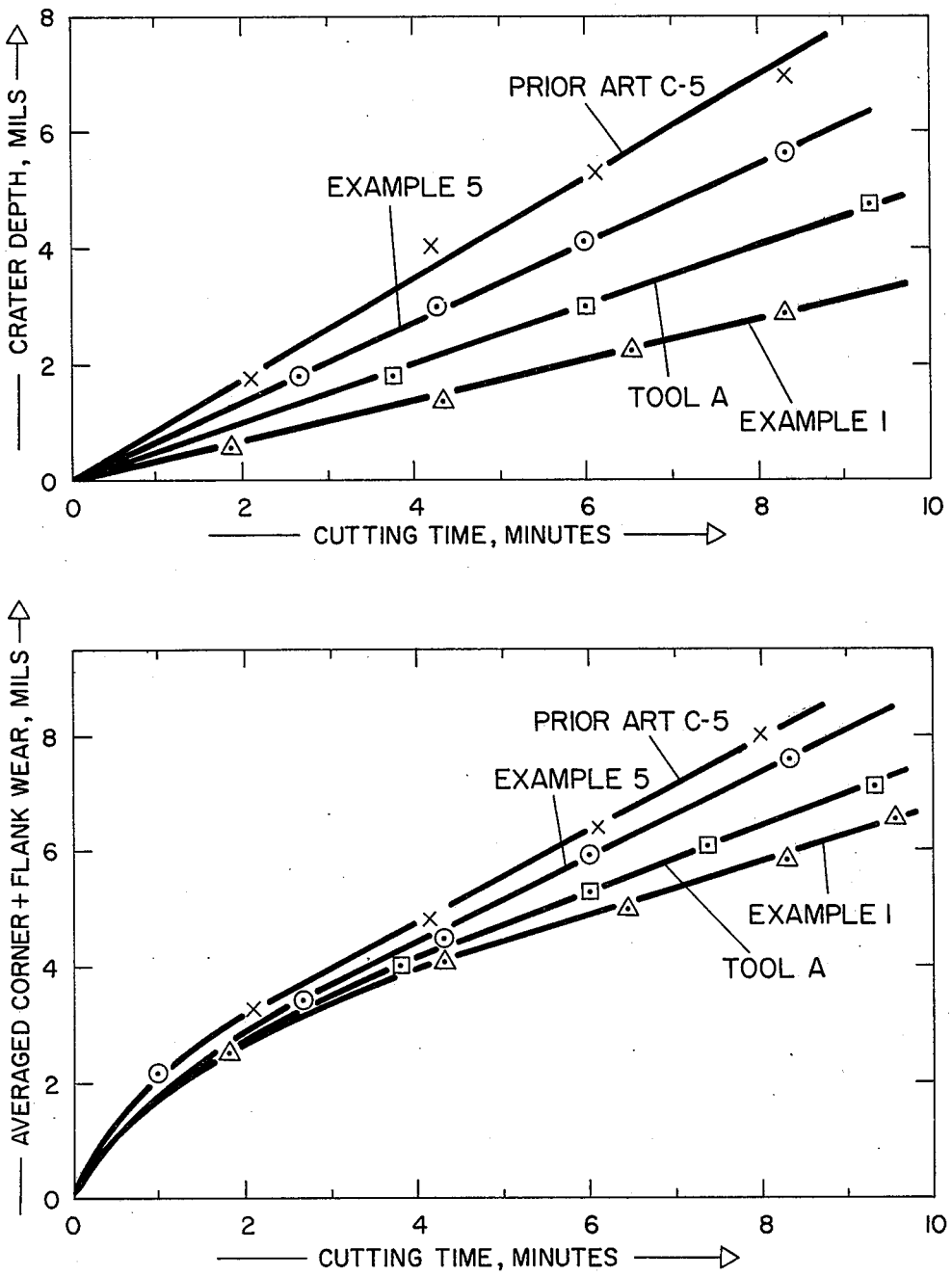
FIGS. 3, 4 and 5 are wear curves, comparing the wear of tools according to the present invention, and according to the prior art, when subjected to identical test conditions.
Figure 4:
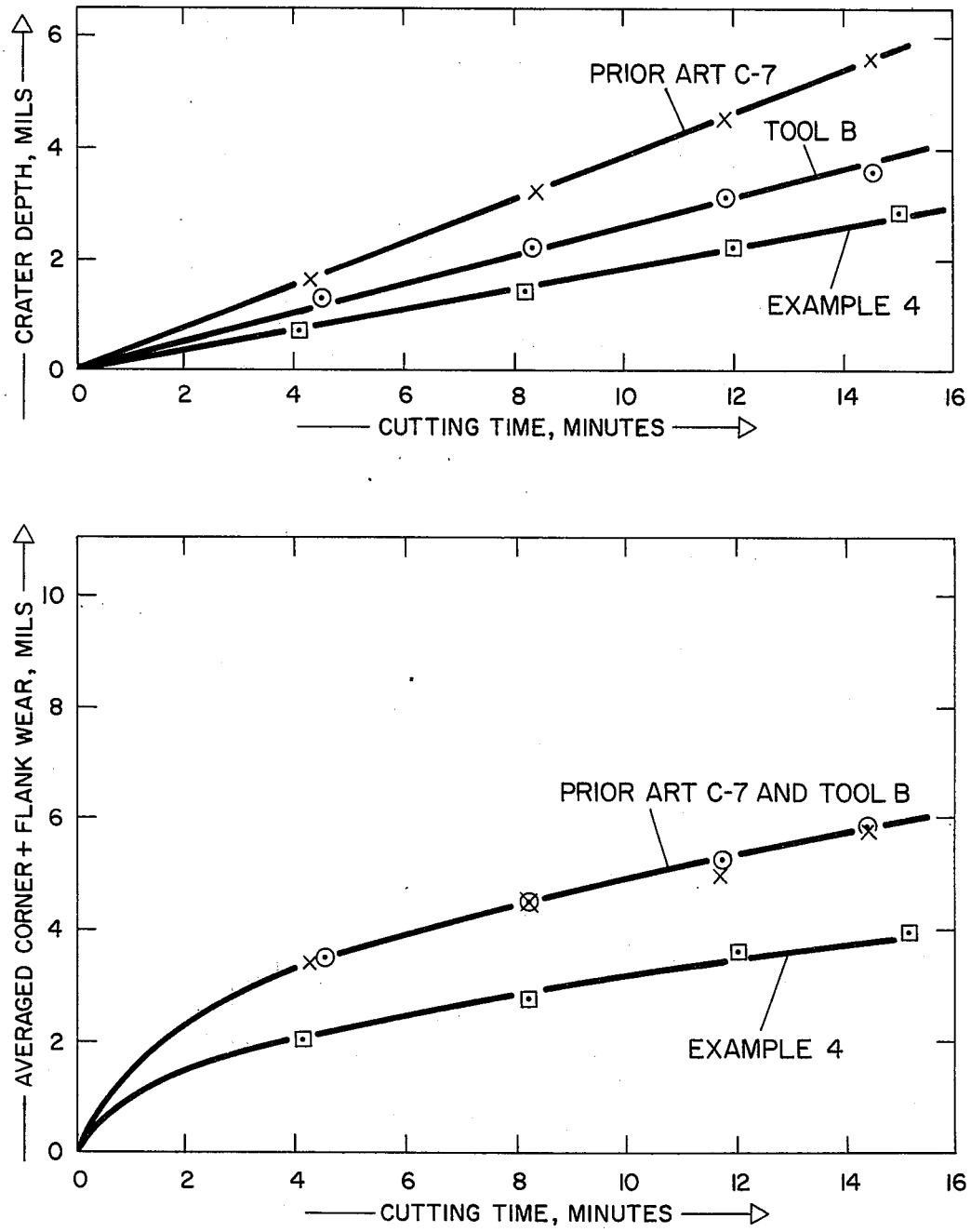

Tool M: $(Ti_{.15}Hf_{.025}Nb_{.025}W_{.80})(C_{.96}N_{.04})$ + 10 vol% Co
Tool N: $(Ti_{.25}Ta_{.10}W_{.65})(C_{.93}N_{.07})$ + 13 vol% Co
Tool O: $(Ti_{.24}Hf_{.10}W_{.66})(C_{.92}N_{.08})$ + 13 vol% Co
Tool P: $(Ti_{.24}Ta_{.05}Nb_{.05}Mo_{.05}W_{.61})(C_{.94}N_{.06})$ + 13 vol% binder (80% Ni, 20% Mo)
Tool Q: $(Ti_{.25}Hf_{.05}Nb_{.05}W_{.65})(C_{.94}N_{.06})$ + 10 vol% Co
Tool R: $(Ti_{.30}Ta_{.05}Hf_{.05}W_{.60})(C_{.93}N_{.07})$ + 7.2 vol% Co FIG. 3 shows the averaged corner and flank wear and the crater wear as a function of the cutting time for tools formed from the above Examples 1 and 5, for another tool, designated Tool A, with a gross composition $(Ti_{.20}Hf_{.05}Nb_{.05}W_{.70})(C_{.95}N_{.05})$+13 vol% Co, and the prior art C-5 carbide described before, when subjected to Test Condition A FIG. 4 shows the averaged corner and flank wear and the crater wear as a function of the cutting time for tools formed from the above Example 4, for another tool, designated Tool B with the gross composition $(Ti_{.25}Hf_{.05}Nb_{.05}W_{.65})(C_{.93}N_{.07})$ + 7.2 vol% Co, and the prior art C-7 carbide described before, when subjected to a Test Condition A.

Figure 5:
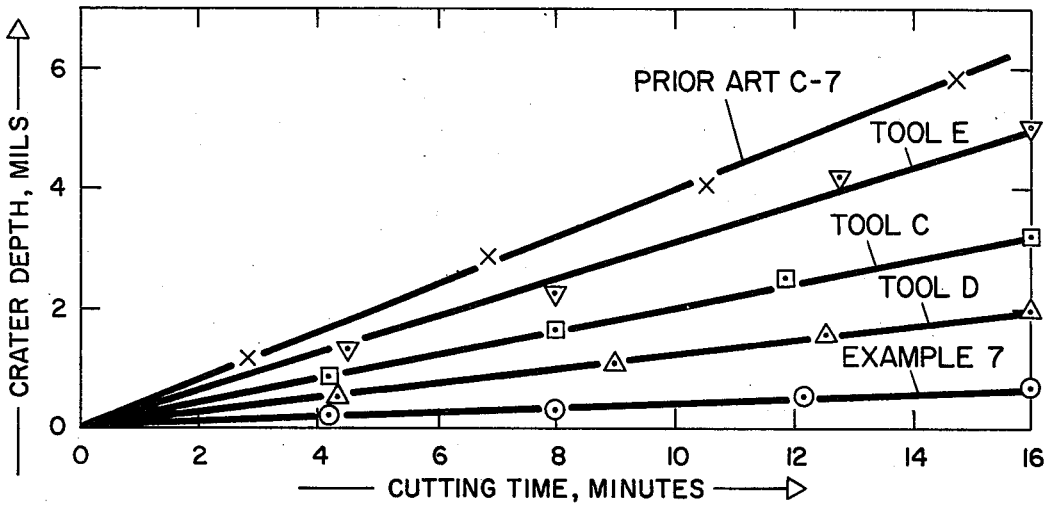
Figure 5:
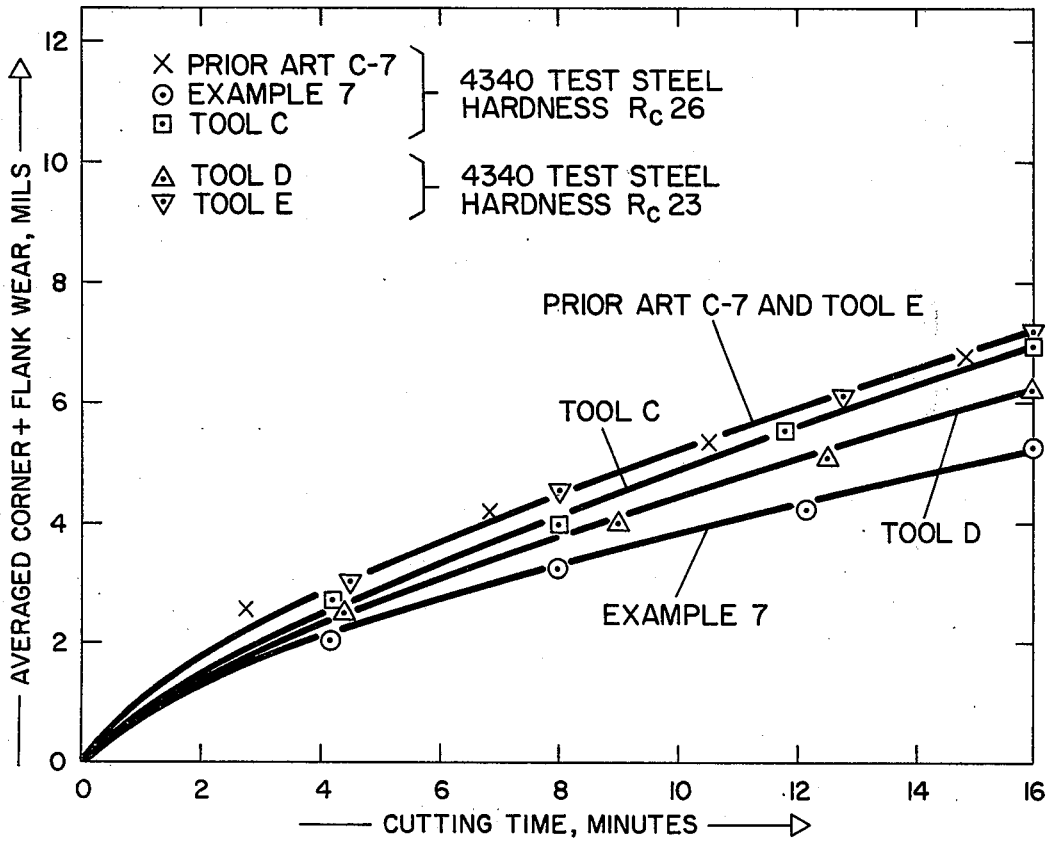

FIG. 5 shows the averaged corner and flank wear and the crater wear as a function of the cutting time for tools formed from above Example 7, for three other tools designated Tools C, D and R, with respective gross compositions $(Ti_{.46}Hf_{.0575}Ta_{.0575}W_{.425})(C_{.89}N_{.11})$ + + 13 vol% Ni, $(Ti_{.46}Hf_{.0575}Nb_{.0575}W_{.425})(C_{.88}N_{.12})$ + 13 vol% Co, and $(Ti_{.46}Hf_{.0575}Ta_{.0575}W_{.425})(C_{.89}N_{.11})$ + 13 vol% Co, and the prior art C-7 carbide described before, when subjected to Test Condition A.

Figure 6:
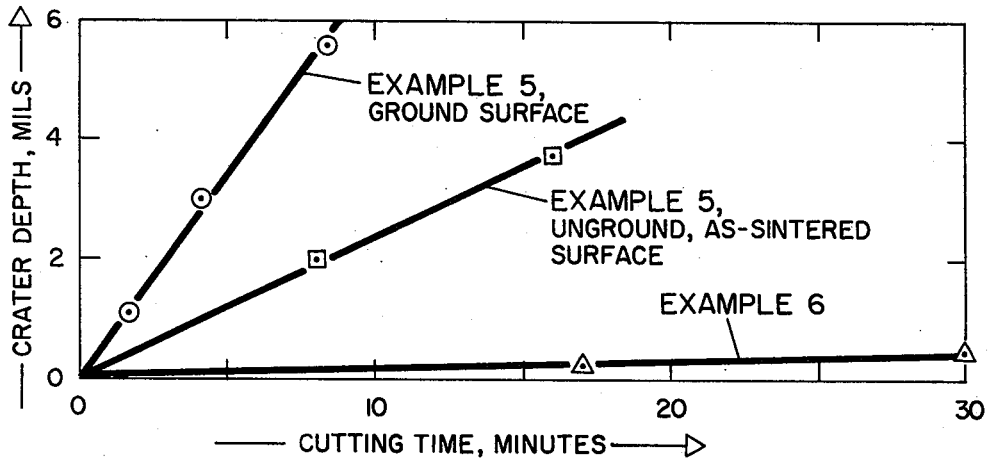
FIG. 6 shows wear curves, comparing the wear of a selected tool composition according to the present invention which has received different surface treatments, when subjected to identical test conditions.
Figure 6:
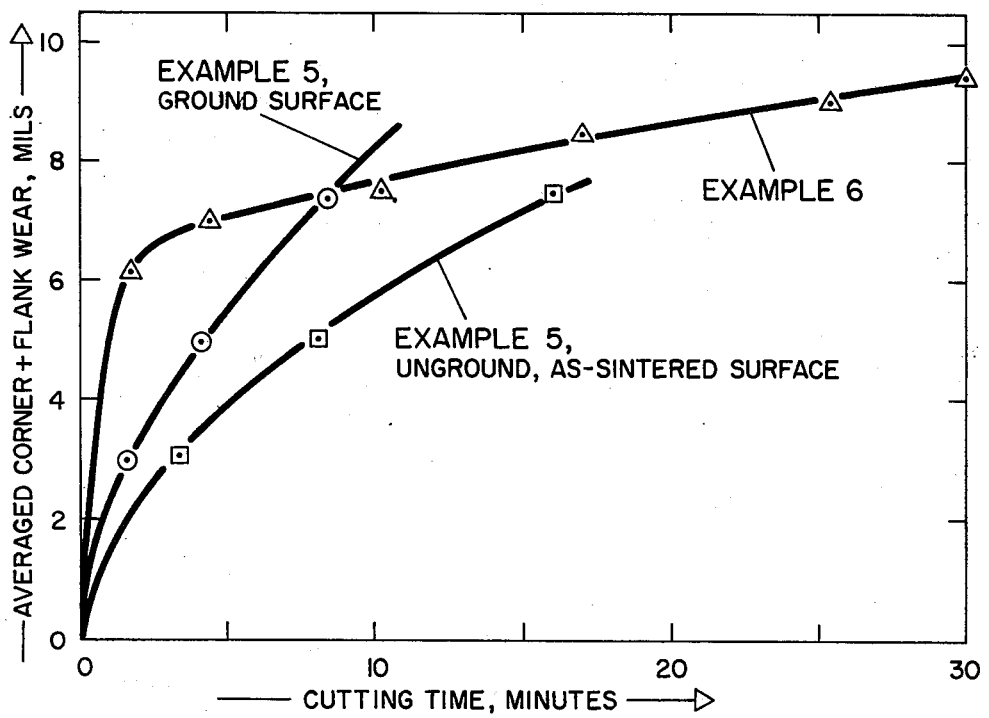

FIG. 6 shows the averaged corner and flank wear and the crater wear as a function of the cutting time for tools formed from the above Examples 5 and 6.

As is shown by FIG. 6, tools used in the unground state have approximately double the wear life when compared to tools where the surface layer was removed by grinding. This is because of the above discussed nitrogen-depleted, hard surface zone of sintered compositions of the present invention. Typically, this nitrogen-depleted, hard surface zone is about 5 to 7 microns in thickness for C-7 type tools and 10 to 20 microns in thickness for C-5 type tools.

Figure 7:
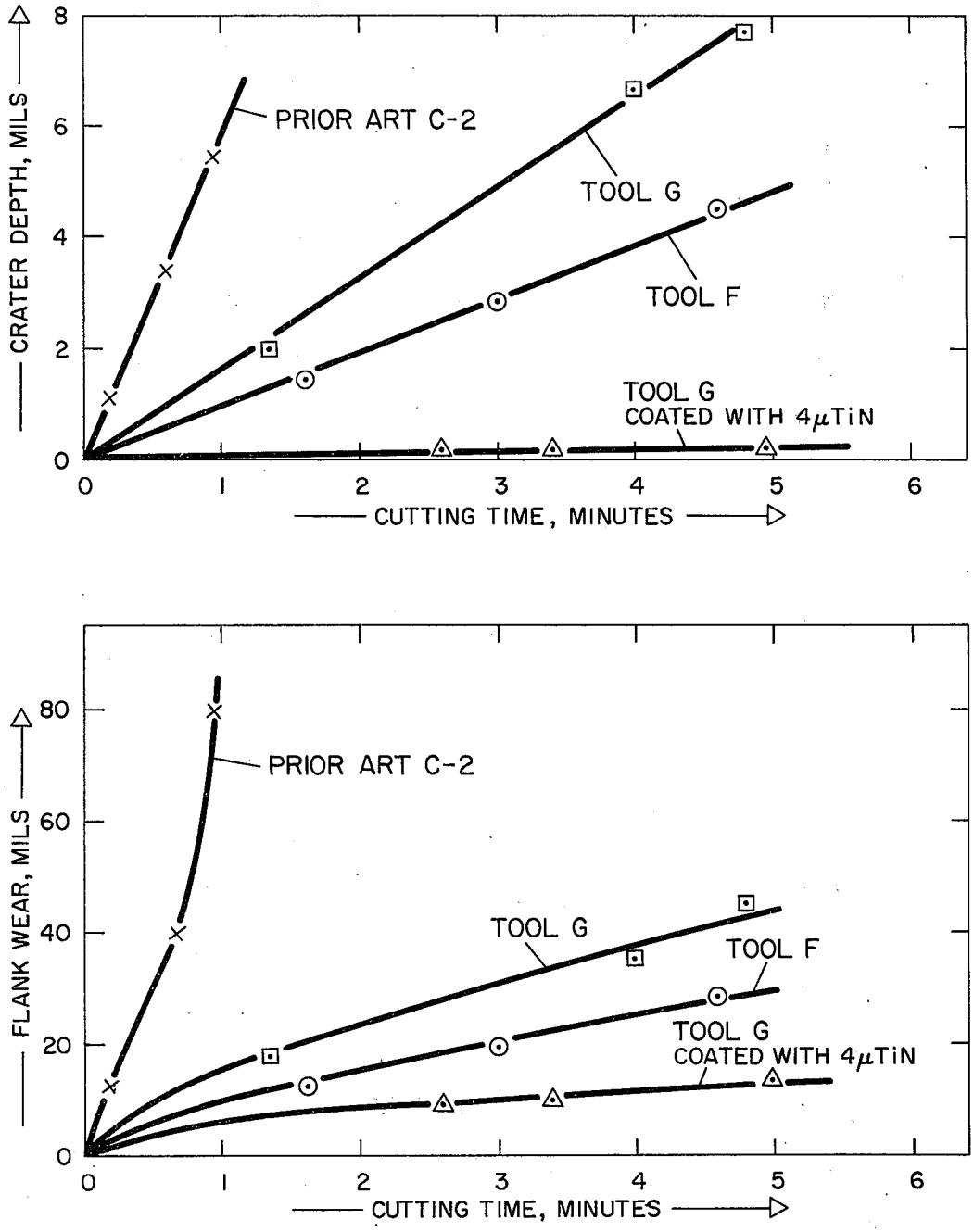
FIG. 7 shows wear curves, comparing the wear of tools according to the present invention, and according to the prior art, when subjected to identical test conditions on the superalloy INCONEL 625.

FIG. 7 shows the averaged corner and flank wear and the crater wear as a function of the cutting time for tools formed from alloys having gross compositions $(Ti_{.25}Hf_{.05}Nb_{.05}W_{.65})$ $(C_{.94}N_{.06})$ + 7.2 vol% Co, designated Tool F, $(Ti_{.25}Hf_{.025}Nb_{.025}W_{.70})$ $(C_{.95}N_{.05})$ +7.4 vol% Co, designated Tool G, Tool G coated with 4 $\mu$ TiN, and the prior art C-2 carbide tool described before, when subjected to Test Condition E.

Figure 8:
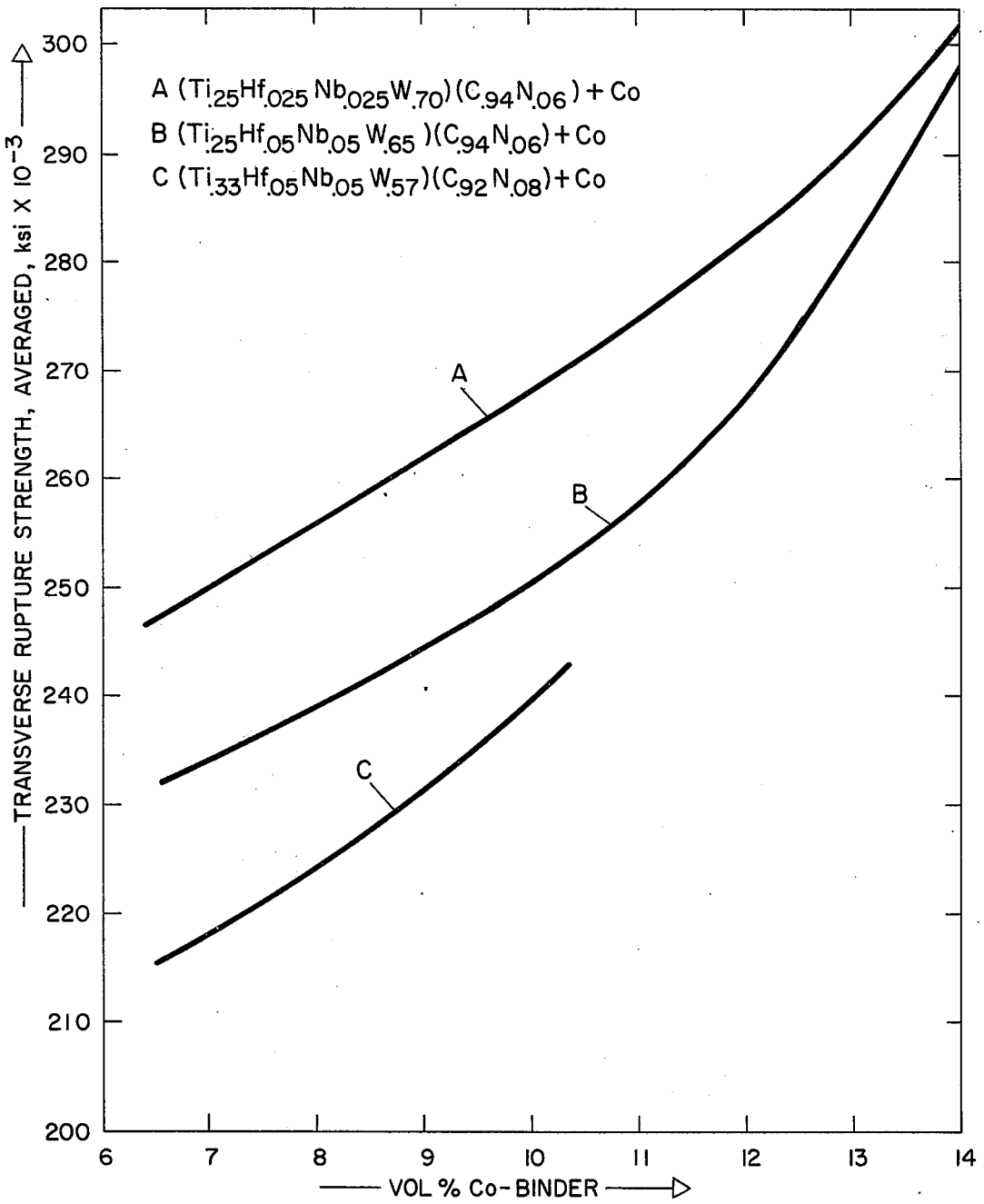
FIG. 8 is a graphical presentation of the binding strength of tools in accordance with the present invention as a function of the binder content of the tool.
Figure 9:
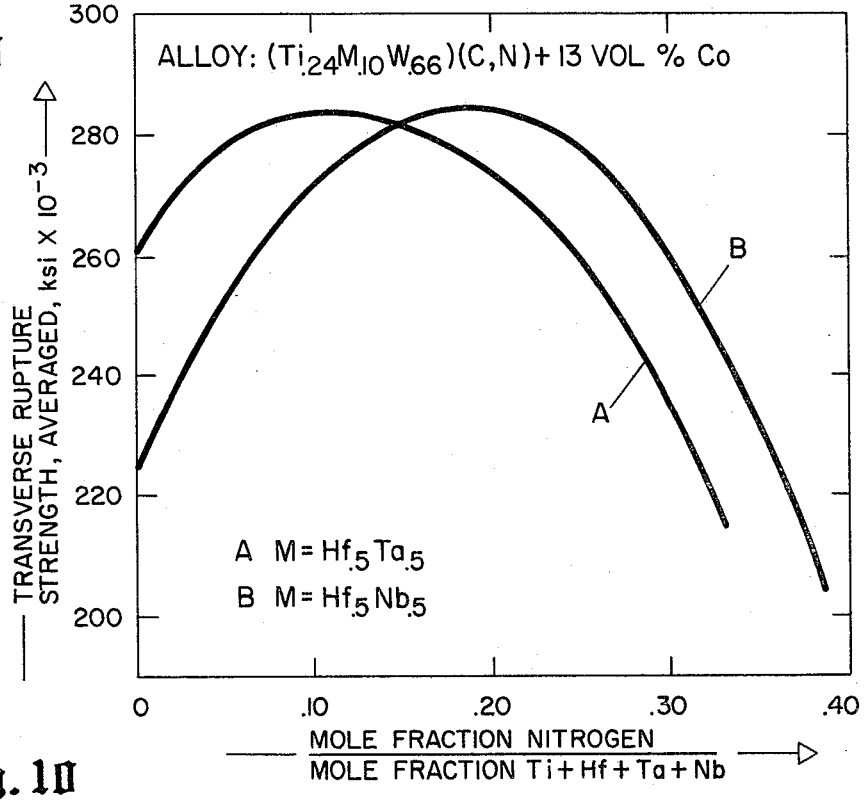
FIG. 9 is a graphical presentation of the bending strength of tools in accordance with the present invention as a function of the relative nitrogen content of the tool.

FIGS. 8 and 9 show the effect of the binder contact and the relative nitrogen content on the bending strength of tools in accordance with the present invention. FIG. 8 shows the bending strength as a function of the binder content for the three given compositions and FIG. 9 shows the bending strength as a function of the ratio of the mole fraction of nitrogen to the combined mole fraction of titanium, hafnium, tantalum and niobium, or to the ratio $vz/x$.

Figure 10:
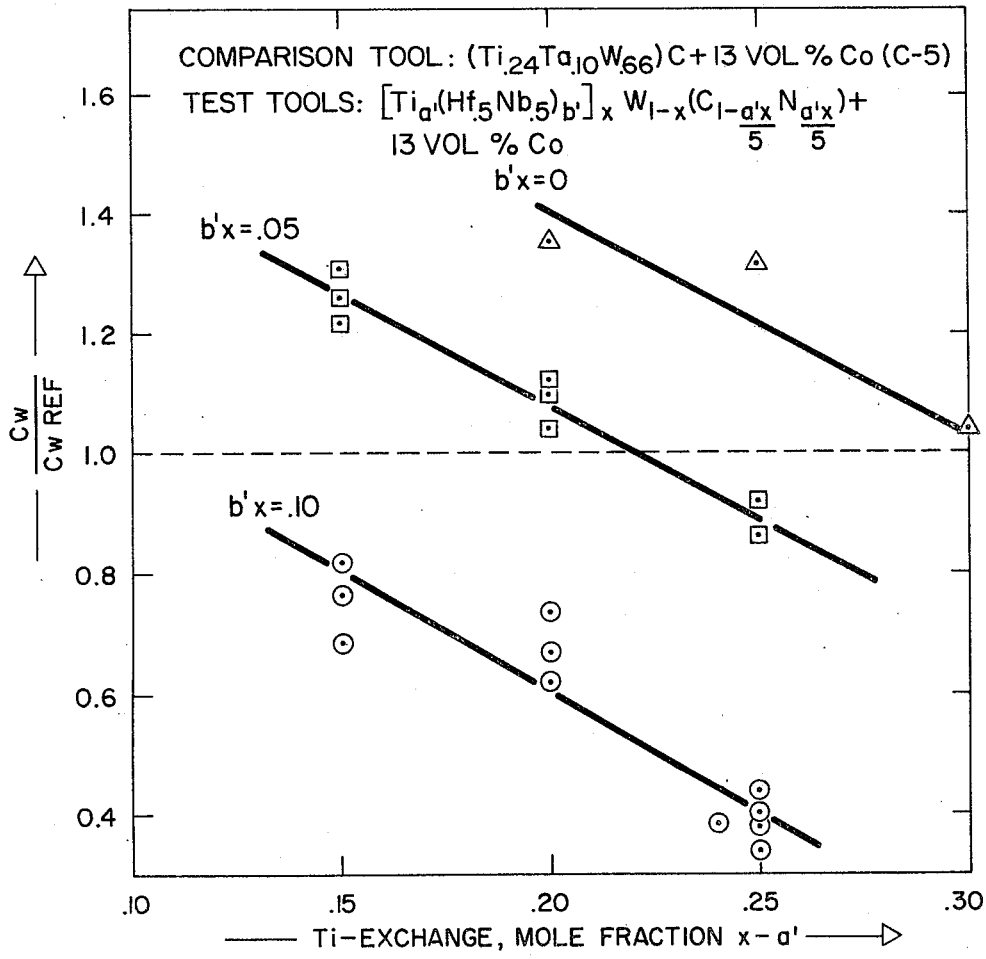
FIGS. 10 and 11 show the cratering rate of tools in accordance with the present invention as a function of the titanium and addition metals content.

FIG. 10 shows the crater wear rates as a function of the titanium and addition metal content of C-5 grade tools formed from the composition of the invention, in comparison to the prior art C-5 carbide tool described before, when subjected to Test Condition A.

Figure 11:
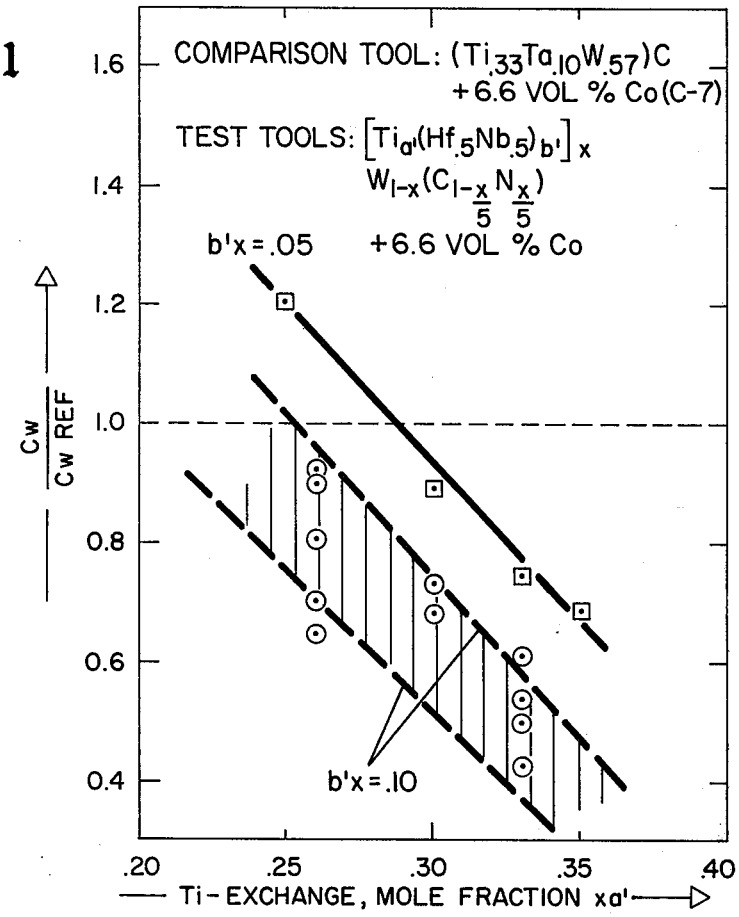

FIG. 11 shows the crater wear rates as a function of the titanium and addition metal content of C-7 grade tools formed from the compositions of the invention, in comparison to the prior art C-7 carbide tool described before, when subjected to Test Condition A.

Figure 12:
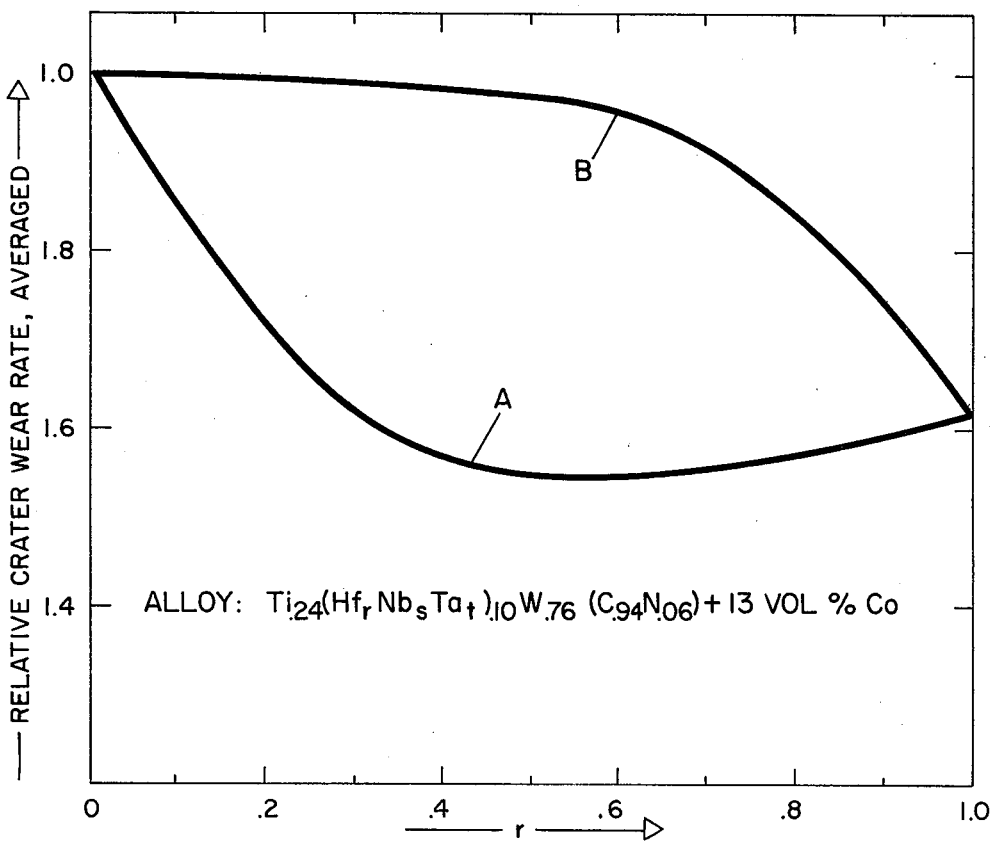
FIG. 12 shows the cratering rate of tools in accordance with the present invention as a function of the hafnium content in the addition metal.

FIG. 12 shows the averaged crater wear rates as a function of the hafnium content in the addition alloys of tools formed from compositions of the invention, when subjected to Test Condition A.

Figure 13:
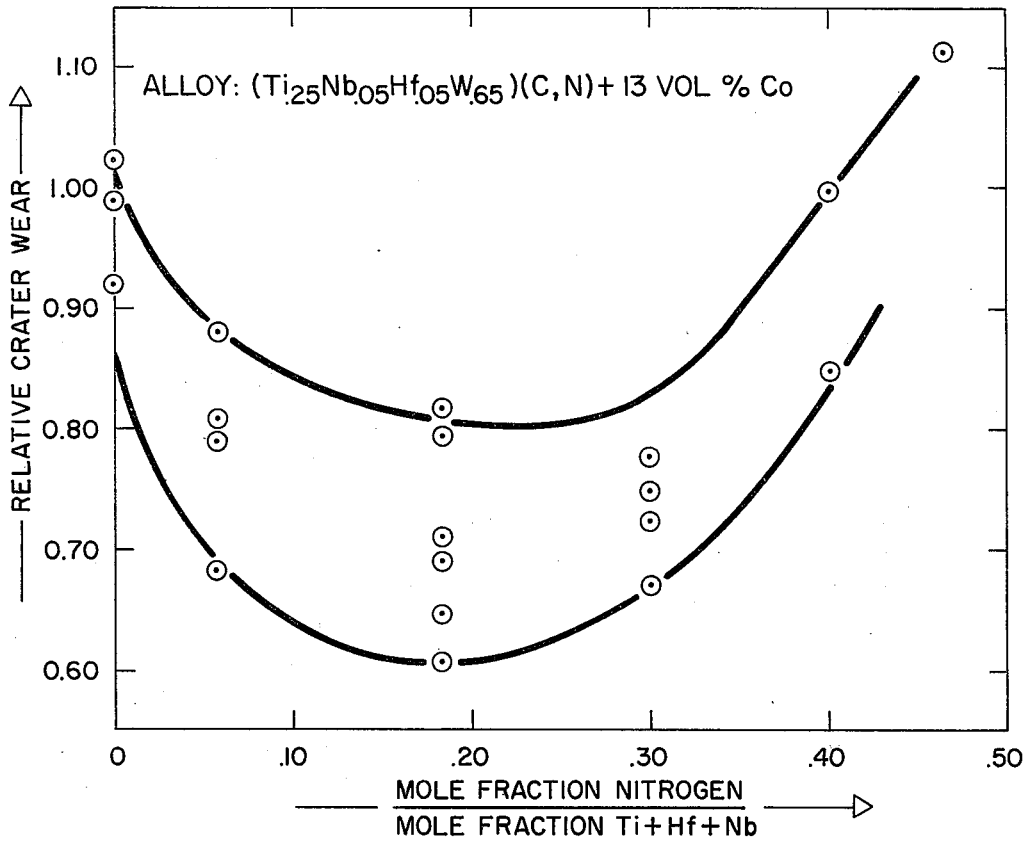
FIG. 13 shows the cratering rate of tools in accordance with the present invention as a function of the relative nitrogen content of the tool.

FIG. 13 shows the relative crater wear as a function of the nitrogen content relative to the metals Ti, Hf, and Nb of tools formed from compositions of the invention, when subjected to Test Condition A.

Figure 14:
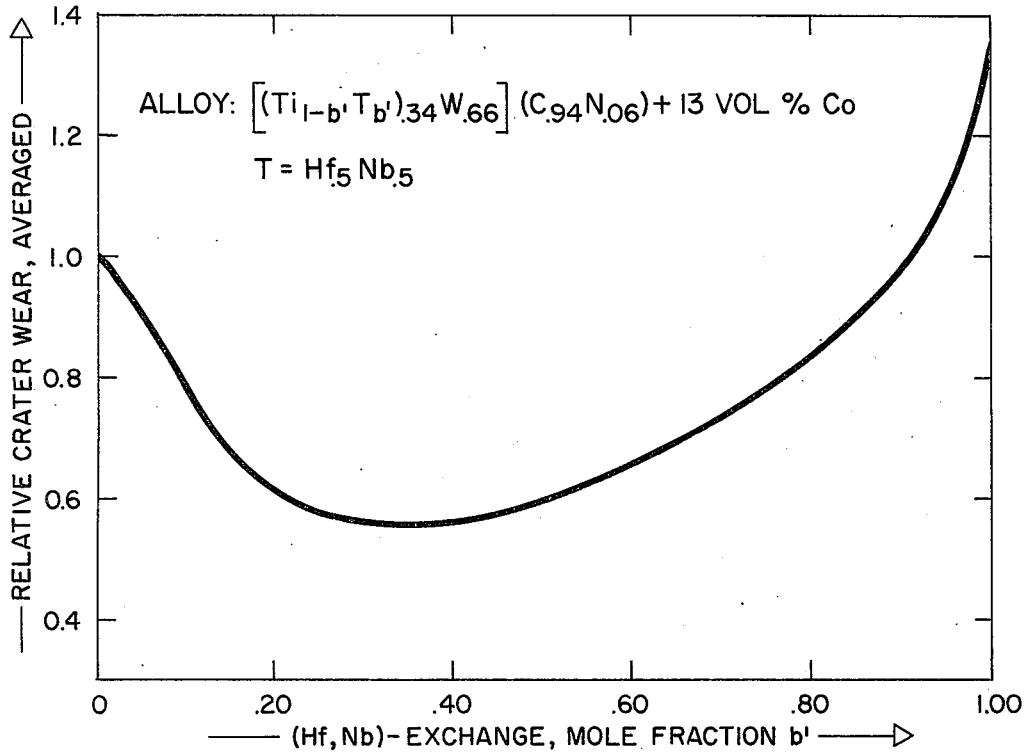
FIG. 14 shows the cratering rate of tools in accordance with the present invention as a function of the hafnium-niobium content in exchange for titanium.

FIG. 14 shows the relative crater wear as a function of the hafnium-niobium content in exchange for titanium of tools formed from compositions of the invention, when subjected to Test Condition A.

It is seen from the curves of FIGS. 3 through 7 and 10 through 14 and Tables 1 through 5 that the tools within the preferred range of the invention have superior strength and wear performance, and about the same toughness, when compared with commercial tools with equivalent alloying levels. For alloys with equivalent grain structures, the carbonitrides also show better thermal deformation resistance than equivalently alloyed carbides. The advantages of improved wear performance of the alloys of the invention in relation to the commercial carbides is lost, if the tools are operated under conditions which lead to substantial thermal deformation of the cutting edges. The good performance of the carbonitride alloys on superalloy INCONEL 625 is particularly noteworthy and is indicative of the high edge strength of the C-7 carbides of the invention, since commercial C-7 grades fail predominantly by flank breakdown after only very short cutting times under the same cutting conditions.

The following Table 6 contains test date for a number of tools prepared from specific compositions in accordance with the present invention when subjected to Test Condition A. When examining the data given for the tool alloys in Table 6, it will be appreciated that many tool compositions showing comparatively poor wear performance or thermal deformation resistance under Test Condition A, may show superior performance under other cutting conditions requiring high toughness and strength. Many of the alloys listed in Table 6 are outside the composition ranges considered competitive with existing tool materials in the envisioned area of application, but have been included to outline more clearly the useful composition boundaries of the alloys of the invention.

TABLE 6

| Gross Composition of Hard Component | Preparation Method | Binder Weight Percent | $t_f$ | $t_c$ | Deformation | Remarks |
|---|---|---|---|---|---|---|
| $(Ti_{.20}Hf_{.025}Nb_{.025}W_{.75})(C_{.95}N_{.05})$ | A | 12.0 Co | — | — | — | heavy edge deformation |
| " | A | 8.2 Co | 7 | 4 | .001" | — |
| " | A | 6.6 Co | 9 | 6 | <.0003" | — |
| " | A | 8.2 Ni | 6 | 4 | .0012" | — |
| " | A | 7.2 Ni, 2Mo | 7 | 4 | <.0003" | |
| $(Ti_{.25}Hf_{.05}Nb_{.05}W_{.65})(C_{.93}N_{.07})$ | A | 8.5 Co | 12 | 9 | .0005" | — |
| " | A | 6.7 Co | 17 | 10 | <.0003" | — |
| " | A | 5.3 Co | 25 | 11 | <.0003" | — |
| " | A | 7.5 Ni, 2 Mo | 12 | 9 | <.0003" | — |
| $(Ti_{.30}Hf_{.05}Nb_{.05}W_{.60})(C_{.92}N_{.08})$ | A | 17 Co | — | — | — | heavy edge deformation |
| " | A | 12 Co | — | — | — | heavy edge deformation |
| " | A | 8.2 Co | 18 | 10 | <.0003" | — |
| " | A | 7 Co | 20 | 15 | <.0003" | — |
| " | A | 5 Co | 26 | 18 | <.0003" | — |
| " | A | 4.5 Co | 28 | 19 | <.0003" | — |
| " | A | 8.2 Ni | 14 | 8 | .0012" | — |
| $(Ti_{.33}Hf_{.05}Nb_{.05}W_{.57})(C_{.92}N_{.08})$ | A | 6.5 Co | 26 | 15 | <.0003" | — |
| " | A | 5.5 Co | 28 | 22 | <.0003" | — |
| " | A | 4.5 Co | 28 | 22 | <.0003" | — |
| " | A | 5 Ni | 22 | 17 | <.0003" | — |
| $(Ti_{.15}Ta_{.10}W_{.75})(C_{.97}N_{.03})$ | A | 8 Co | 4 | 3 | .0023" | — |
| $(Ti_{.25}Ta_{.10}W_{.65})(C_{.95}N_{.05})$ | A | 8.5 Co | 10 | 5 | .0013" | — |
| " | A | 6.5 Co | 13 | 6 | <.0003 | — |
| " | A | 8.5 Ni, 2 Mo | 10 | 5 | .001" | — |
| $(Ti_{.33}Ta_{.10}W_{.57})(C_{.92}N_{.08})$ | A | 6.5 Co | 15 | 7 | <.0003" | — |
| " | A | 5.2 Co | 23 | 12 | <.0003" | — |
| " | A | 4.5 Co | 24 | 12 | <.0003" | — |
| " | A | 6.5 Ni, 1 Mo | 13 | 7 | <.0003" | — |
| $(Ti_{.25}Ta_{.05}Nb_{.05}W_{.65})(C_{.94}N_{.06})$ | A | 8.5 Co | 10 | 5 | .0010" | — |
| " | A | 8.5 Ni | 8 | 4 | .0014" | — |
| " | A | 7.5 Ni, 1.5 Mo | 11 | 5 | .001" | — |
| $(Ti_{.33}Ta_{.05}Nb_{.05}W_{.57})(C_{.92}N_{.08})$ | A | 4.8 Co | 27 | 12 | <.0003" | — |
| " | A | 4.8 Ni | 22 | 12 | <.0003" | — |
| $(Ti_{.15}Nb_{.05}W_{.80})(C_{.97}N_{.03})$ | A | 8 Co. | 4 | 2 | .002" | — |
| " | A | 8 Ni | 4 | 2 | .0025" | — |
| $(Ti_{.25}Nb_{.10}W_{.65})(C_{.95}N_{.05})$ | A | 8.5 Co | 9 | 4 | .001" | — |
| " | A | 8.5 Ni | 9 | 4 | .0012" | — |
| " | A | 8.0 Ni, 2 Mo | 10 | 7 | .0005" | — |
| $(Ti_{.30}Nb_{.10}W_{.60})(C_{.92}N_{.08})$ | A | 5.0 Co | 18 | 11 | <.0003" | — |
| " | A | 5.0 Ni | 16 | 11 | <.0003" | — |
| $(Ti_{.25}Hf_{.05}Nb_{.05}Mo_{.05}W_{.60})(C_{.94}N_{.06})$ | A | 8.5 Co | 15 | 9 | <.0003" | — |
| " | A | 8.5 Ni | 13 | 9 | .0005" | — |
| " | A | 8.5 Ni, 2 Mo | 17 | 9 | <.0003" | — |
| $(Ti_{.25}Ta_{.10}Mo_{.05}W_{.60})(C_{.95}N_{.05})$ | A | 8.5 Co | 9 | 5 | .001" | — |
| " | A | 8.5 Ni | 9 | 5 | .0012" | — |
| " | A | 8.5 Ni, 1.5 Mo | 11 | 6 | <.0003" | — |
| $(Ti_{.25}Nb_{.10}Mo_{.05}W_{.60})(C_{.94}N_{.06})$ | A | 8.5 Co | 9 | 5 | .0012" | — |
| " | A | 8.5 Ni | 7 | 5 | .002" | — |
| " | A | 8.5 Ni, 2 Mo | 10 | 5 | .0005" | — |
| $(Ti_{.25}Nb_{.05}Hf_{.05}W_{.65})(C_{.94}N_{.06})$ | A | 10 Co, 3 Fe | 6 | 5 | .001" | notching,de- |

TABLE 6-continued

| Gross Composition of Hard Component | Preparation Method | Binder Weight Percent | $t_f$ | $t_c$ | Deformation | Remarks |
|---|---|---|---|---|---|---|
| | | | | | | formation |
| " | A | 6.5 Co, 2 Fe | — | — | — | microporosity |
| " | A | 7 Co, 1.5 Fe | 12 | 7 | <.0003" | some microporosity |
| " | A | 7 Ni 1.5 Fe | 12 | 9 | <.0003" | — |
| " | A | 4.25 Ni, 4.25 Co | 15 | 9 | .0005" | — |
| " | A | 4 Ni, 4 Co, 0.5 Fe | 12 | 9 | <.0003" | — |
| $(Ti_{.25}Ta_{.05}Hf_{.05}W_{.65})(C_{.94}N_{.06})$ | A | 15 Co, 3 Fe | — | — | — | deformation, breakage |
| " | A | 10 Co, 2 Fe | — | — | — | deformation, breakage |
| " | A | 8.5 Co | 9 | 5 | .0008" | — |
| " | A | 6 Ni 2.5 Fe | — | — | — | alloy porous |
| " | A | 6 Ni 1.5 Fe | 8 | 5 | — | light micro-porosity |
| $(Ti_{.25}Hf_{.05}Nb_{.05}W_{.65})(C_{.90}N_{.10})$ | B | 8.5 Co | 10 | 7 | .0005" | — |
| " | B | 7.5 Ni, 1.5 Mo | 12 | 9 | <.0003" | — |
| $(Ti_{.25}Nb_{.10}W_{.65})(C_{.91}N_{.09})$ | B | 8.5 Co | 8 | 5 | .001" | light micro-porosity |
| " | B | 8.5 Ni, 2 Mo | 10 | 5 | <.0003" | — |
| $(Ti_{.25}Ta_{.10}W_{.65})(C_{.91}N_{.09})$ | B | 8.5 Co | 9 | 5 | .0008" | — |
| $(Ti_{.33}Hf_{.05}Ta_{.05}W_{.57})(C_{.89}N_{.11})$ | B | 5.0 Co | — | — | — | alloy porous |
| " | B | 5.0 Ni | — | — | — | " |
| " | B | 5.0 Ni, 1 Mo | — | — | — | " |
| $(Ti_{.25}Nb_{.05}Ta_{.05}W_{.65})(C_{.94}N_{.06})$ | A | 8.5 Co | 8 | 5 | .0012" | — |
| $(Ti_{.25}Hf_{.95}Nb_{.025}Ta_{.025}W_{.65})(C_{.93}N_{.07})$ | A | 8.5 Co | 11 | 7 | .0006" | — |
| $(Ti_{.45}Ta_{.10}W_{.45})(C_{.94}N_{.06})$ | A | 9 Co | 13 | 7 | <.0003" | — |
| " | A | 8 Ni, 1 Mo | 14 | 7 | <.0003" | — |
| $(Ti_{.45}Nb_{.10}W_{.45})(C_{.92}N_{.08})$ | A | 9 Co | 11 | 7 | .001" | — |
| " | A | 8 Ni, 1 Mo | 16 | 9 | <.0003" | — |
| $(Ti_{.45}Nb_{.05}Ta_{.05}W_{.45})(C_{.92}N_{.08})$ | A | 9 Co | 14 | 9 | <.0003" | — |
| " | A | 9 Ni | 14 | 8 | .0008" | — |
| $(Ti_{.45}Hf_{.05}Nb_{.05}Mo_{.11}W_{.34})(C_{.90}N_{.10})$ | A | 9 Co | 20 | 13 | <.0003" | — |
| " | A | 9 Ni | 26 | 32 | <.0003" | — |

LEGEND: $t_f$ = Minutes cutting time to reach .008" flank wear
$t_c$ = Minutes cutting time to reach .004" crater depth
Deformation = Edge corner deformation after 5 minutes cutting time.
Preparation Method A = Addition metals Hf, Nb and Ta added as carbides or carbide solutions
Preparation Method B = Addition metals Hf, Nb and Ta incorporated into master carbonitride.

The compositions of the present invention are formed from carbonitride master alloys, eventual addition carbides, and tungsten carbide, with a binder selected from metals of the iron group, in particular nickel and cobalt; the binder alloy may also contain smaller alloying additions of certain refractory metals, such as molybdenum and tungsten, for attaining optimum strength of selected tool compositions. The binder content of the composites of the invention can vary from 3 to 20 percent by weight of the composition. If too little binder is used, the compositions will be too brittle, if too much binder is used, the alloy will be too soft and may thermally deform in the machining operation. When used as a cutting tool, the binder contents are preferably between 4 and 12 percent by weight of the composition.

Selection of the proper binder alloy is additionally dependent upon the gross composition of the tool alloy and the desired characteristics of the sintered compacts: In terms of wear performance, tools and nickel and cobalt binders proved about equivalent for alloys containing up to 50 atomic percent tungsten in the hard phase. The hardness of the nickel-bonded tool alloys with comparable grain structures are typically about one point on the Rockwell A scale less than the equivalent cobalt-bonded compositions, and the average transverse rupture strengths were also about 10% below those obtained with cobalt.

For tool compositions in which the group Vi metal exchange (or 100 times the parameter $y$) in the hard alloy exceeds substantially 50 atomic percent, wear performance of the nickel-bonded tool alloys becomes better than that of the cobalt-bonded tools, while the strength levels are about the same. Presence of small quantities of iron in the tool alloys, which may result from the diverse milling operations during master alloy and tool batch fabrication, are without noticeable effect upon performance and properties, but the total iron content should not exceed 15 percent by weight of the binder in order to avoid embrittlement and loss of strength of the tool alloys of the invention.

Alloying additions to the binder metals can improve thermal deformation resistance and strength of selected tool alloys. Thus, for example, strength of nickel-bonded tools can be improved by low level molybdenum and tungsten additions (5 to 25 percent by weight of the binder), particularly to the C-5 and high-titanium cemented carbonitride alloys of the invention. The strengthening effect of molybdenum additions is particularly noticeable in compositions, in which the carbonitride master alloy is primarily based on the system Ti(Hf,Nb,Ta)—Mo—C—N. No molybdenum or tungsten additions to the cobalt binder are recommended, unless used to correct for excessive amounts of the carbon in the hard alloy component.

Chromium additions in excess of 10 percent by weight of the binder causes the appearance of brittle, hard phases formed by interaction with tungsten carbide, and severe deterioration of strength and embrittlement of the tool alloy.

The properties of the carbonitride-carbide-binder metal composities of the invention can further be extensively modified by alloying of the carbonitride phase and by choice of the ingredient components for a given gross composition. The following summary of the effects of the principal alloying ingredients are based on observations of their fabrication characteristics, measured properties, and on performance studies of the composites as tool materials in turning 4340 steel. However, low level alloying with other elements can also be accomplished without departing from the spirit of the invention.

1. For a given composition, better fabricability and strength of alloys is obtained, if the addition carbides (Hf, Nb, Ta)C, are added separately to the carbonitride mix instead of being prealloyed into the master carbonitride. If higher nitrogen contents in the carbonitride are desired, it is preferable to incorporate a portion of the niobium and tantalum into the carbonitride.
2. For a given gross content of the metals Ti,Hf,Nb, and Ta, crater wear is improved by partial substitution of titanium by hafnium, but complete replacement of titanium by hafnium leads to alloys with less wear resistance when compared with the alloy containing only titanium. Wear performance of alloys with Nb and Ta as addition metals, but no hafnium, are about equivalent in wear performance, but the Ta-alloy composites have better strength and toughness. Additional partial alloying with hafnium significantly improves wear performance only of the alloys containing niobium, although the difference in the cratering resistance between tools less with decreasing binder content of the alloys. The effectivity in impeding recrystallization and grain growth in the cemented alloys decreases in the order Hf, Ta and Nb.
3. Partial exchange of tungsten by molybdenum, best accomplished by partial, or complete, replacement of tungsten by molybdenum in the carbonitride master alloy, somewhat improves wear performance but decreases toughness by reducing the amount of tungsten carbide present in the finished alloy. Alloying of the carbonitride with molybdenum is indicated to offer advantages only if used in conjunction with a nickel, or a nickel-molybdenum binder; C-5 type tool alloys on this basis showed exceptionally good performance in milling hardened steels.
4. For a given gross metal component composition in the carbonitride, cratering and thermal deformation resistance of the alloys increases with increasing nitrogen content. However, if the ratio between the mole fraction of nitrogen and the combined mole fractions of the addition metals Ti, Hf, Nb and Ta exceeds 0.30, fabricability and metallurgical quality of the alloys is increasingly impaired and performance deteriorates correspondingly.
5. Low level additions of vanadium to the addition carbides, or to the master carbonitride, did not have a measurable effect on wear performance and strength properties. Higher concentrations of vanadium (> 10 at % of the gross metal component) in alloys, which also contains significant quantities of hafnium, cause the formation of a separate, hafnium-and-nitrogen-rich cubic phase, and impair the sintering behavior of the alloys.
6. Chromium in replacement of molybdenum or tungsten in the carbonitride master alloy facilitates the nitriding reaction in the preparation of master carbonitride according to Method 1; substitution of more than 8 atomic percent of the metal component in the master carbonitride by chromium causes exosolution of chromium carbide during sintering, and formation of free graphite by decomposition of the chromium carbide in the presence of nickel or cobalt binder.
7. Using the same alloy substrates of tools coated with TiN showed, in the average, better wear performance than tools coated with TiC of the same thickness.
8. Better coating adherence and tool life was achieved with low alloy C-5 (such as described in Example 5) and C-7 (such as described in Example 3) type tool compositions of the present invention, than with fully alloyed types, as represented by Examples 1 and 4. While the practical limit for the coating thickness of TiN on commercial carbide tool substrates lies around 10 microns because of increased spalling tendency of thicker coatings, spall-resistant coatings up to 25 microns in thickness have been prepared on the carbonitride tool alloys of the invention, yielding tool lives more than double those of coated conventional carbides.
9. Tool inserts in accordance with the present invention may also be coated with surface layers of wear-resistant materials other than TiN and TiC, such as HfC, HfN and $Al_2O_3$. The thickness of any such wear-resistant layers may be from 1 to 30 microns.

The following Table 7 shows the wear rates for a number of tools formed from compositions incorporating some of the alloy substitutions just discussed when these tools were subjected to Test Condition A.

The data shown in the above-discussed tables and graphs are representative of many other alloys within the range of the invention which were prepared and tested. It becomes evident from a comparison of the performance data that the new carbonitride alloys of the invention offer a substantial improvement in performance of the cemented carbides of the state of the art designed for similar applications.

TABLE 7

| Gross Composition of Hard Component | Preparation Method | Binder Weight Percent | $t_f$ | $t_c$ | Deformation | Remarks |
|---|---|---|---|---|---|---|
| $(Ti_{.25}Hf_{.05}Nb_{.05}W_{.65})C$ | A | 8.5 Co | 9 | 5 | .0016" | — |
| $(Ti_{.25}Hf_{.05}Ta_{.05}W_{.65})C$ | A | 8.5 Co. | 11 | 4 | .001" | — |
| $(Ti_{.25}Hf_{.10}W_{.65})C$ | A | 8.5 Co | 11 | 5 | .001" | — |
| " | A | 8.5 Ni | 10 | 5 | .001" | — |
| $(Ti_{.15}Hf_{.05}Nb_{.05}W_{.75})(C_{.90}N_{.10})$ | B | 8 Co | 8 | 4 | .0008" | light porosity |
| " | B | 8 Ni | 8 | 4 | .001" | " |
| $(Ti_{.25}Hf_{.05}Nb_{.05}W_{.65})(C_{.98}N_{.02})$ | A | 8.5 Co | 10 | 6 | .0005" | — |
| " | A | 8.5 Ni | 9 | 5 | .001" | — |
| " | A | 8 Ni, 1 Mo | 12 | 7 | <.0003" | — |
| $(Ti_{.25}Hf_{.05}Nb_{.05}W_{.65})(C_{.88}N_{.12})$ | A | 8.5 Co | 14 | 8 | <.0003" | — |
| " | A | 6.5 Ni, 2 Fe | 8 | 8 | — | notching tendency |
| $(Ti_{.25}Hf_{.05}Nb_{.05}W_{.65})(C_{.89}N_{.11})$ | B | 8.5 Co | 6 | 5 | —10 | alloy porous |
| $(Ti_{.25}Hf_{.05}Nb_{.05}W_{.65})(C_{.86}N_{.14})$ | B | 8.5 Co | 4 | 5 | — | alloy porous |
| $(Ti_{.25}Hf_{.05}Nb_{.05}W_{.65})(C_{.86}N_{.14})$ | B | 8.0 Ni, 1 Mo | 7 | 6 | .0005" | light porosity |
| $(Ti_{.25}Hf_{.10}W_{.65})(C_{.92}N_{.08})$ | A | 8.5 Co | 13 | 8 | <.0003" | — |
| " | A | 8.5 Ni | 14 | 8 | .0005" | — |
| $(Ti_{.30}Nb_{.05}Ta_{.05}Mo_{.05}W_{.55})(C_{.93}N_{.07})$ | A | 7.5 Ni, 2 Mo | 9 | 5 | — | — |
| $(Ti_{.30}Hf_{.05}Nb_{.05}W_{.60})(C_{.91}N_{.09})$ | A | 8.5 Co | 16 | 10 | <.0003" | — |
| $(Ti_{.30}Hf_{.05}Nb_{.05}W_{.60})(C_{.88}N_{.12})$ | A | 8.5 Co | 18 | 11 | <.0003" | — |

TABLE 7-continued

| Gross Composition of Hard Component | Preparation Method | Binder Weight Percent | $t_f$ | $t_c$ | Deformation | Remarks |
|---|---|---|---|---|---|---|
| $(Ti_{.30}Hf_{.05}Nb_{.05}W_{.60})(C_{.84}N_{.16})$ | B | 8.5 Co | 11 | 12 | <.0003" | alloy porous |
| $(Ti_{.30}Ta_{.10}W_{.60})(C_{.84}N_{.16})$ | B | 8.5 Co | — | — | — | nitrogen loss during sintering |
| " | B | 8.5 Ni | — | — | — | " |
| $(Hf_{.25}Ta_{.10}W_{.65})(C_{.90}N_{.10})$ | B | 8.0 Co | — | — | — | microporosity |
| " | B | 8.0 Ni | — | — | — | " |
| $(Ti_{.18}Hf_{.17}W_{.65})(C_{.95}N_{.05})$ | A | 8.2 Co | 11 | 9 | <.0003" | hard component three-phased |
| " | A | 8.2 Ni | 12 | 10 | <.0003" | " |
| $(Ti_{.18}Hf_{.17}W_{.65})(C_{.88}N_{.12})$ | B | 8.2 Co | 12 | 11 | <.0003" | microporosity |
| " | B | 7.2 Ni, 2.5 W | 12 | 11 | <.0003" | " |
| $(Ti_{.25}Hf_{.05}Nb_{.05}Mo_{.06}W_{.59})(C_{.90}N_{.10})$ | B | 8.6 Co | 11 | 8 | <.0003" | light microporosity |
| " | B | 8.6 Ni | 12 | 8 | <.0003" | " |
| $(Ti_{.25}Hf_{.025}Nb_{.025}Mo_{.06}W_{.64})(C_{.91}N_{.09})$ | A | 8.6 Co | 14 | 8 | <.0003" | — |
| " | A | 8 Ni, 1 Mo | 15 | 9 | <.0003" | — |
| $(Ti_{.25}Hf_{.05}Nb_{.05}Cr_{.05}W_{.60})(C_{.94}N_{.06})$ | A | 8.6 Co | — | — | — | excess carbon and separate Cr-rich phases |
| $(Ti_{.25}Hf_{.05}Nb_{.05}Cr_{.05}W_{.60})(C_{.94}N_{.06})$ | A | 8.6 Ni | — | — | — | excess carbon and separate Cr-rich phases |
| $(Ti_{.25}Hf_{.05}Nb_{.05}Cr_{.02}Mo_{.03}W_{.60})(C_{.94}N_{.06})$ | A | 8.6 Co | 12 | 9 | <.0003" | — |
| " | A | 8.6 Ni | 13 | 9 | <.0003" | — |
| $(Ti_{.25}Hf_{.05}V_{.05}W_{.65})(C_{.94}N_{.06})$ | A | 8.6 Ni | 11 | 7 | .0008" | — |
| $(Ti_{.25}V_{.10}W_{.65})(C_{.94}N_{.06})$ | A | 8.7 Co | 12 | 7 | <.0003" | — |
| $(Ti_{.20}Hf_{.075}Nb_{.075}W_{.65})(C_{.94}N_{.06})$ | A | 8.4 Co | 15 | 8 | <.0003" | — |
| $(Ti_{.175}Hf_{.085}Nb_{.085}W_{.655})(C_{.94}N_{.06})$ | A | 8.3 Co | 13 | 7 | <.0003" | — |
| $(Ti_{.15}Hf_{.10}Nb_{.10}W_{.65})(C_{.94}N_{.06})$ | A | 8.3 Co | 12 | 6 | <.0003" | — |
| $(Ti_{.05}Hf_{.15}Nb_{.15}W_{.65})(C_{.94}N_{.06})$ | B | 8.1 Co | 8 | 3 | <.0003" | — |

LEGEND $t_f$ = *Minutes cutting time to reach .008" flank wear.*

$t_c$ = Minutes cutting time to reach .004" crater depth.

Deformation = Edge corner deformation after 5 minutes cutting time.

Preparation Method A = Addition metals Hf, Nb and Ta added as carbides or carbide solutions.

Preparation Method B = Addition metals Hf, Nb and Ta incorporated into master carbonitride.

While the invention is thus disclosed and many embodiments described in detail, it is not intended that the invention be limited to those shown embodiments. Instead, many embodiments and uses will occur to those skilled in the art which fall within the spirit and scope of the invention. It is intended that the invention be limited only by the appended claims.

What is claimed is:

1. A composition of material comprising sintered carbonitride-binder metal alloys in which the carbonitride has the formula $(M'_xM_y)(C_uN_v)_z$, where $M' = Ti_a(Hf_rNb_sTa_t)_b$, with $a' + b' = 1$ and $b' \leqq a'$ and $r+s+t=1$, $M = W_aMo_b$, with $a+b=1$ and $b$ $a$, and $0.90 \leqq z \leqq 1.00$, and where the value of $y$ is from greater than 0.40 to 0.85 and the range of the value of $v$ as a function of $y$, with the upper limit of the value of $v$ as a function of $y$ being defined by the line BC of FIG. 1 and the lower limit of the value of $v$ as a function of $y$ being defined by the line AD of FIG. 1, in which the binder is selected from metals of the iron group and comprises between 3 and 20 weight percent of the composition, and in which the carbonitride component of the alloy is a two phase mixture comprising an M' and nitrogen-rich carbonitride solid solution, and another hard phase which is rich in the M metal components and poor in nitrogen, and the two-phase mixture forming a microstructure in which the M' and nitrogen-rich carbonitride phase is surrounded by the phase rich in M metal but poor in nitrogen and forms the main interface with the binder alloy.

2. A composition of material according to claim 1 in which the value of $y$ is from greater than 0.40 to 0.78, and when the range of the value of $v$ is a function of $y$, with the upper limit of the value of $v$ as a function of $y$ being defined by the line B'C' of FIG. 1 and the lower limit of the value of $v$ as a function of $y$ being defined by the line A'D' of FIG. 1.

3. A composition of material according to claim 1 in which the iron metal binder is selected from the group consisting of cobalt and nickel and comprises between 4 and 12 percent of the composition.

4. A composition of material according to claim 1 in which the binder comprises nickel and an additional metal selected from the group consisting of molybdenum and tungsten and that the addition metal comprises between 2 and 30 percent of the weight of the nickel.

5. A composition of material according to claim 1 in which up to 20 atomic percent of the combined contents of the metals titanium, hafnium, niobium and tantalum are replaced by vanadium.

6. A composition of material according to claim 1 in which up to 5 atomic percent of the combined contents of the metals molybdenum and tungsten are replaced by chromium.

7. A composition of material according to claim 1 in which up to 15 weight percent of the binder is iron and the balance of the binder is selected from the group consisting of cobalt and nickel.

8. A composition of material according to claim 7 in which the binder comprises between 4 and 12 weight percent of the composition.

9. The method of forming a composition of material comprising sintered carbonitride-binder metal alloys in which the carbonitride has the formula $(M'_xM_y)(C_uN_v)_z$, where $M' = Ti_a(Hf_rNb_sTa_t)_b$, with $a'+b' = 1$ and $b' \leqq a'$ and $r+s+t=1$, $M = W_aMo_b$, with $a+b=1$ and $b \leqq a$, and $0.90 \leqq z \leqq 1.00$, and where the value of $y$ is from greater than 0.40 and 0.85 and the range of the value of $v$ is a function of $y$, with the upper limit of the value of $v$ as a function of $y$ being defined by the line BC of FIG. 1 and the lower limit of the value of $v$ as a function of $y$ being defined by the line AD of FIG. 1, and in which the carbonitride component of the alloy is a two phase mixture comprising the M′ and nitrogen-rich carbonitride solid solution, and another hard phase which is rich in the M metal components and poor in nitrogen, and the two-phase mixture forming a microstructure in which the M′ and nitrogen-rich carbonitride phase is surrounded by the phase rich in M metal but poor in nitrogen and forms the main interface with the binder alloy, comprising the steps of:

forming carbonitride master alloys $(Ti,T',T)(C,N)_z$, in which T′ is a metal selected from the group consisting of hafnium, niobium, and tantalum, and T is a metal selected from the group consisting of molybdenum and tungsten, by nitriding appropriate mixtures of carbide and metal powders with nitrogen-bearing gases at temperatures ranging between 1450° C and 1900° to form a homogenous solution at these temperatures;

cooling the carbonitride alloy powder to cause it to decompose into a two phase mixture comprising an M′ and nitrogen-rich carbonitride solid solution, and another hard phase which is rich in the M metal components and poor in nitrogen, with the twophase mixture forming a microstructure in which the M′ and nitrogen-rich carbonitride phase is surrounded by the phase rich in M metal but poor in nitrogen;

mixing the powder of said carbonitride alloy with preformed tungsten carbide powder and additional metal carbides selected from the group consisting of HfC, NbC, and TaC, so as to achieve the desired gross composition;

further adding binder metal to said mixture;

mechanically milling said mixture under inert fluids until it has uniform consistency and the desired grain size;

compacting said milled mixture to a desired shape; and sintering the compact so formed at an elevated temperature.

10. A composition of material according to claim 1 which further includes a surface coating of wear-resistant materials selected from the group consisting of TiN, TiC, HfC, HfN and $Al_2O_3$.

11. A composition of material according to claim 10 in which the thickness of the surface coating of wear-resistant materials is from 1 to 30 microns.

* * * * *